US006264305B1

(12) United States Patent
Inui et al.

(10) Patent No.: US 6,264,305 B1
(45) Date of Patent: Jul. 24, 2001

(54) RECORDING METHOD AND APPARATUS USING RECORDING HEAD EJECTING BOTH INK AND RECORD IMPROVING LIQUID

(75) Inventors: Toshiharu Inui, Yokohama; Jiro Moriyama, Kawasaki; Hiroshi Tajika, Yokohama; Yutaka Kurabayashi, Tokorozawa; Hitoshi Sugimoto, Yokohama; Kiichiro Takahashi; Fumihiro Gotoh, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/523,212

(22) Filed: Sep. 5, 1995

(30) Foreign Application Priority Data

Sep. 2, 1994 (JP) ..... 6-210260
Aug. 2, 1995 (JP) ..... 7-197548

(51) Int. Cl.[7] ..... B41J 2/21
(52) U.S. Cl. ..... 347/40; 347/15; 347/43
(58) Field of Search ..... 342/40, 43, 15, 342/24, 7, 96, 98, 101; 358/502, 298, 534

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/60 |
| 4,630,076 | | 12/1986 | Yoshimura | 346/140 |
| 4,723,129 | | 2/1988 | Endo et al. | 347/56 |
| 4,740,796 | | 4/1988 | Endo et al. | 347/56 |
| 5,624,484 | * | 4/1997 | Takahashi et al. | 106/31.75 |
| 5,635,969 | * | 6/1997 | Allen | 347/96 |
| 5,984,449 | * | 11/1999 | Tajika et al. | 347/15 |
| 6,033,055 | * | 3/2000 | Nagoshi et al. | 347/43 |

FOREIGN PATENT DOCUMENTS

| | | | | |
|---|---|---|---|---|
| 0610096 | | 8/1994 | (EP) . | |
| 61-249755 | * | 4/1975 | (JP) | 347/96 |
| 54-056847 | | 5/1979 | (JP) . | |
| 59-123670 | | 7/1984 | (JP) . | |
| 59-138461 | | 8/1984 | (JP) . | |
| 60-071260 | | 4/1985 | (JP) . | |
| 61-249755 | | 11/1986 | (JP) . | |
| 63-299971 | * | 12/1988 | (JP) | 347/96 |
| 64-63185 | * | 6/1989 | (JP) | 347/96 |

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

A recording head for ejecting ink to effect recording on a recording material includes a first group of ejection outlets, arranged in a first direction, for ejecting record improving liquid for improving record property on the recording material; a second group of ejection outlets arranged in the first direction for ejecting ink having a first density; a third group of ejection outlets, arranged in the first direction, for ejecting ink having a second density which is lower than the first density; wherein the first, second and third groups are arranged in a second direction which is different from the first direction.

19 Claims, 14 Drawing Sheets

IH
IL
IS
SHEET (SUBSCAN)

i-3
i-2
i-1
i
HP
SIDE
CARRIAGE MOVEMENT (MAIN SCAN)

i-2
i-1
i
i+1 i-1
i
i+1
i+2 i
i+1
i+2
i+3 i
i+1
i+2
i+3
i+4

RECORDING METHOD AND APPARATUS USING RECORDING HEAD EJECTING BOTH INK AND RECORD IMPROVING LIQUID

FIELD OF THE INVENTION AND RELATED ART

The present invention relates to a recording head, a recording apparatus using the recording head, and a recording method using the same, more particularly to a recording head, a recording head using the same and a recording method using the same for ink jet recording.

Ink jet recording is used for a printer, copying machine or the like because it is advantageous in the low noise, low running cost, easiness of downsizing and color printing. Particularly, many types of color recording machines have been put into practice.

In the color recording apparatus of this type, it is necessary to use a recording sheet exclusively for the recording in order to provide high quality. On the other hand, by the improvement of the ink, an apparatus usable with plain paper has been put into practice. However, the image quality thereof is still low.

More particularly, when a full-color image is to be formed on plain paper a quick-dry ink exhibiting high seeping speed into plain paper is used. Therefore, a high quality image can be produced without smear between colors. However, in the case of a line image such as characters, results in feathering occurs along the fibers of the paper, thus deteriorating the image quality. Particularly, the feathering is conspicuous in the case of black letter, with the result of less sharp image, and therefore, the quality is relatively poor.

In order to provide a high quality image without feathering and with high density of black portion, it is desirable that the ink relatively slow in the seeping into the plain paper is ejected to the paper to a certain extent. However, in this case, the smear between the black ink and the color ink results in the boundary between the black image and the color image portions with the result of remarkable deterioration of the quality.

In order to improve these problems, it has been proposed and put into practice that a heater is provided in a recording apparatus to promote ink drying to provide a color image without the smearing between colors. However, this increases the cost and the size of the apparatus.

Thus, an ink jet recording apparatus which can provide high density of the black image on the plain paper, which can provide sharp black image without feathering and which does not produce ink smear between the black image and the color image and between the color images, has not been accomplished with low cost and high practicability.

However, the demand for the high quality of the image and the demand for the tone reproducibility, are increased.

In order to meet the demand, it has been proposed that a plurality of recording heads ejecting the same color ink droplets with different density is provided to produce low density ink is used for the light and intermediate tone levels, and that a high density ink is used from the intermediate to the dark portions.

This method requires increase of the number of recording heads and the number of ink cartridges with the result of bulky apparatus. When the use is made with ink having different densities for the respective colors, there arises a difficult problem of non-uniformity in the recorded image attributable to the order of the different color and different density inks.

SUMMARY OF THE INVENTION

Accordingly, it is a principal object of the present invention to provide a recording head, a recording apparatus using the same and a recording method, with which high density sharp images can be provided without feathering on plain paper, thus permitting formation of high quality color image with high tone gradation and without smearing between colors.

According to an aspect of the present invention, there is provided a recording head for ejecting ink to effect recording on a recording material, comprising: a first group of ejection outlets, arranged in a first direction, for ejecting record improving liquid for improving record property on the recording material; a second group of ejection outlets arranged in the first direction, for ejecting ink having a first density; a third group of ejection outlets, arranged in the first direction, for ejecting ink having a second density which is lower than the first density; wherein the first, second and third groups are arranged in a second direction which is different from the first direction.

According to another aspect of the present invention, there is provided a recording apparatus comprising: a recording head for ejecting ink to effect recording on a recording material, the recording head including a first group of ejection outlets, arranged in a first direction, for ejecting record improving liquid for improving record property on the recording material; a second group of ejection outlets, arranged in the first direction, for ejecting ink having a first density; a third group of ejection outlets, arranged in the first direction, for ejecting ink having a second density which is lower than the first density; wherein the first, second and third groups are arranged in a second direction which is different from the first direction; input means for inputting image information from an outside; comparing means for comparing a density of the image information with a predetermined level; ink ejection control means for ejecting ink onto the recording material in accordance with an output of the comparing means, by the second group when the density level of the image information exceeds the predetermined level, and by the third group when the density level of the image information is lower than the predetermined level; and record improving liquid ejection control means, responsive to the image information, for ejecting the record improving liquid by the first ejection group to a position where the liquid is mixed on the recording material with the ink ejected by the second ejection group or the third ejection group.

According to a further aspect of the present invention, there is provided a recording method comprising: providing a recording head for ejecting ink to effect recording on a recording material, the recording head including a first group of ejection outlets, arranged in a first direction, for ejecting record improving liquid for improving record property on the recording material; a second group of ejection outlets, arranged in the first direction, for ejecting ink having a first density; a third group of ejection outlets, arranged in the first direction, for ejecting ink having a second density which is lower than the first density; wherein the first, second and third groups are arranged in a second direction which is different from the first direction; inputting image information from an outside; comparing a density of the image information with a predetermined level; ejecting, in accordance with the image information, record improving liquid onto the recording material at a position to be mixed with ink; ejecting ink onto the recording material in accordance with a result of the comparing step, by the second group when the density level of the image information exceeds the predetermined level; ejecting ink onto the recording material ir accordance with a result of the comparing step, by the third group when the density level of the image information is lower than the predetermined level; and record improving liquid ejection control means, responsive to the image information, for ejecting the record improving liquid by the first ejection group to a position where the liquid is mixed on the recording material with the ink ejected by the second ejection group or the third ejection group.

Thus, the level of density indicated by color image information externally supplied is compared with a predetermined level. When the recording is effected while ejecting the ink from the recording head onto the recording material, a first group of nozzles for ejecting recording improving liquid containing a material capable of making the coloring material in the ink insoluble or coagulated, is ejected onto the recording material. In accordance with the results of comparison, if the density level of the color image information exceeds the predetermined level, the recording is effected using a second group of nozzles ejecting a plurality of color inks having a first density. If the density level is lower than the predetermined level, the recording is effected using a third group of nozzles for ejecting color inks having a second density which is lower than the first density.

The improvement of the record means improvement in the density, chroma, sharpness at the edge, dot diameter or the like, thus improving the record quality. It includes improvement in the ink fixing property, water resistance, light resistance or the like, durability of the image. It also includes suppression of smearing or white cloud. The recording improvement liquid means liquid capable of improving the above-described record quality. It includes an agent or agents capable of making the coloring material in the ink insoluble or coagulated. It includes a liquid capable of making the dye in the ink insoluble, or causing dispersion break down of pigments in the ink, or the like. As the process of making the ink insoluble, the anion group in the dye and the cation group in the cation material contained in the record improving liquid make ion-reaction to produce ion coupling with the result that the dye dissolved uniformly in the ink is separated from the solvent. In this invention, it is not always necessary to making all the dye insoluble, because color bleeding, color improvement, character quality improvement and the fixing property improvement can be provided. Coagulation has the same meaning as insoluble in the case that the coloring material in the ink is a water-soluble dye having anion group. If the coloring material in the ink is pigment, the cation group of cation material contained in the record improving liquid and the surface of the pigment material or the pigment dispersing material, make ion-reaction with the result of dispersion break down of the pigment material, thus significantly increasing the diameter of the pigment particles. Usually, with the coagulation, the viscosity of the ink increases. In this invention, it is not always necessary that all of the pigment material or the pigment dispersing material are coagulated, because the suppression of the color bleeding, improvement of the coloring, the improvement of the character quality, the fixing property improvement, are possible.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the embodiments of the present invention will be described in detail.

Embodiment 1

Figure 1:
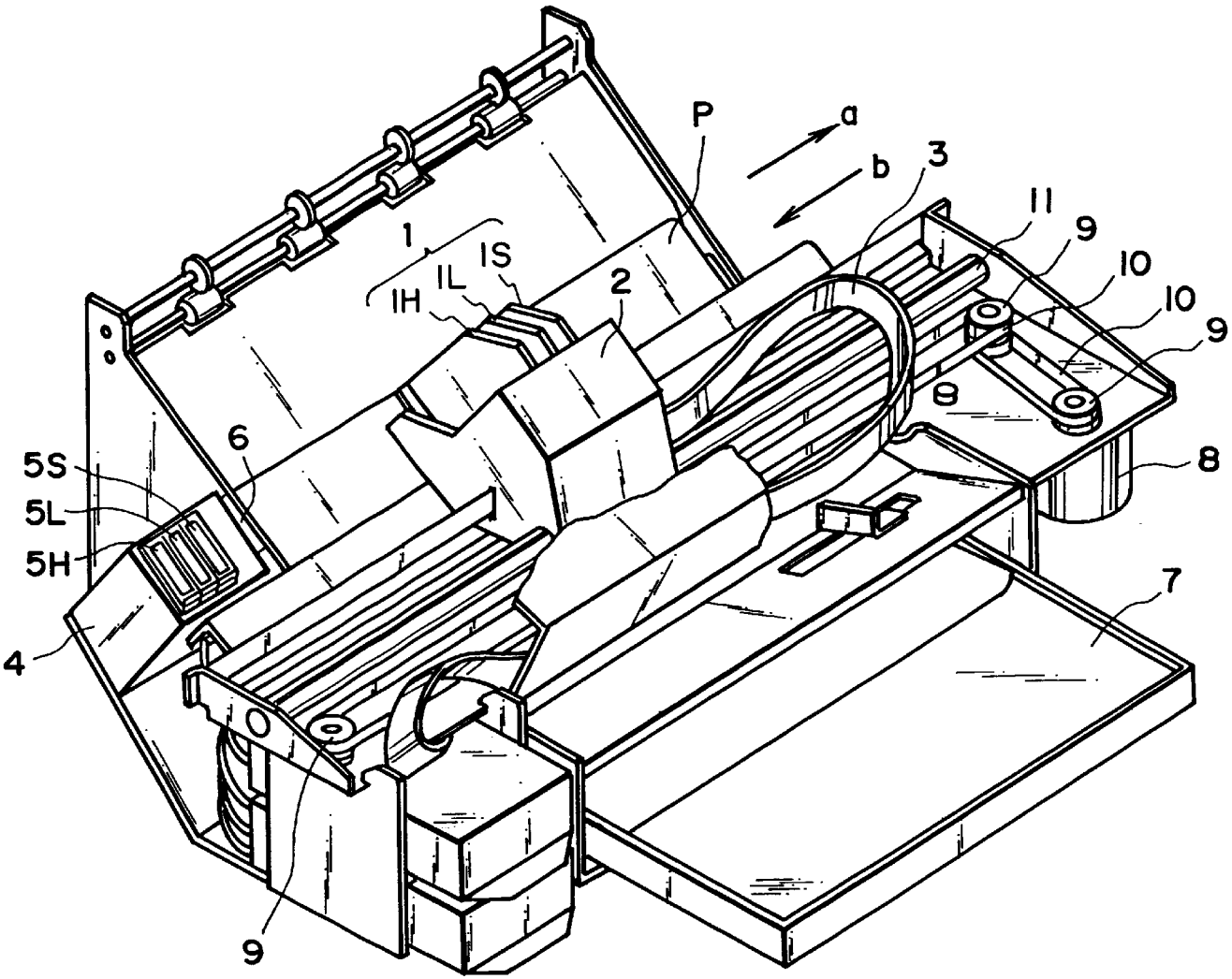
FIG. 1 is a perspective view of an outer appearance of a color printer of an ink jet type according to a first embodiment of the present invention.

FIG. 1 is a perspective view of an outer appearance of a color printer (printer) of an ink jet type which is a typical embodiment of the present invention. In FIG. 1, it comprises a dark ink recording head 1H, a light ink recording head 1L, a record improving liquid head 1S, a carriage 2 for carrying the recording heads, a flexible cable 3 for supplying electric signals from the main assembly of the printer, a cap unit 4 for recovering the recording head by sucking the ink out of the nozzles of the recording head, capping members 5H, 5L, 5S for the recording heads 1 (including recording heads 1H, 1L and 1S), end a wiper blade 6 of rubber or the like. Here, the dark ink means the ink having high content of the coloring material such as dye or pigment or the like, the light ink means the ink having low content of the coloring material. The prescription of the ink and the record improving liquid, are shown in Tables 1, 2 and 3 (percentage by weight).

The printer further comprises a cassette 7 for the recording sheets, a carriage motor 8 for reciprocating the carriage in the directions a and b, a pulley 9 for transmitting the rotation of the carriage motor, a belt 10 for transmitting the rotation to the pulley 9, an auxiliary rod 11 for supporting movement of the carriage 2. Designated by P is a recording material.

The color printer further comprises a feeding motor (not shown) for feeding the recording sheet P, an interface for receiving image signal from a host computer, and a control circuit for controlling the recording head, the feeding of the recording material and the processing of the image signal. Here, the moving direction of the carriage is called "main scan direction", and the direction of the feeding of the recording sheet P is called "sub-scan direction".

TABLE 1

| Color | Ingredient | wt. % |
|---|---|---|
| Yellow | Triethyleneglycol | 7 |
| | Hexanetrial | 7 |
| | Isopropylalcohol | 2.5 |
| | Acethylenol | 0.02 |
| | C.I. Direct Yellow 86 | 1.5 |
| | Water | 81.98 |
| Magenta | Triethyleneglycol | 7 |
| | Hexanetriol | 7 |
| | Isopropyl alcohol | 1.5 |
| | Acethylenol | 0.01 |
| | C.I. Acid Red 289 | 2.5 |
| | Water | 81.99 |
| Cyan | Triethyleneglycol | 7 |
| | Hexanetriol | 7 |
| | Isopropylalcohol | 1.5 |
| | Acethylenol | 0.01 |
| | C.I. Direct Blue 199 | 2.5 |
| | Water | 81.99 |
| Black | Triethyleneglycol | 6 |
| | Hexanetriol | 6 |
| | Isopropylalcohol | 2 |
| | Lithium acetate | 0.1 |
| | C.I. Direct Black 154 | 3 |
| | Water | 82.9 |

TABLE 2

| Color | Ingredient | wt. % |
|---|---|---|
| Yellow | Triethyleneglycol | 7 |
| | Hexanetriol | 7 |
| | Isopropylalcohol | 2.5 |
| | Acethylenol | 0.02 |
| | C.I. Direct Yellow 86 | 0.15 |
| | Water | 83.33 |
| Magenta | Triethyleneglycol | 7 |
| | Hexanetriol | 7 |
| | Isopropylalcohol | 1.5 |
| | Acethylenol | 0.01 |
| | C.I. Acid Red 289 | 0.35 |
| | Water | 84.14 |
| Cyan | Triethyleneglycol | 7 |
| | Hexanetriol | 7 |
| | Isopropylalcohol | 1.5 |
| | Acethylenol | 0.01 |
| | C.I. Direct Blue 199 | 0.3 |
| | Water | 84.19 |
| Black | Triethyleneglycol | 6 |
| | Hexanetriol | 6 |
| | Isopropylalcohol | 2 |
| | Lithium acetate | 0.1 |
| | C.I. Direct Black 154 | 0.4 |
| | Water | 85.5 |

TABLE 3

| Ingredient | wt. % |
|---|---|
| Polyacrylamine-hydrochloride | 1 |
| Tributylamine chloride | 1 |

TABLE 3-continued

| Ingredient | wt. % |
|---|---|
| Thioglycol | 10 |
| Acethylenol | 0.5 |
| Water | 87.5 |

Figure 2:
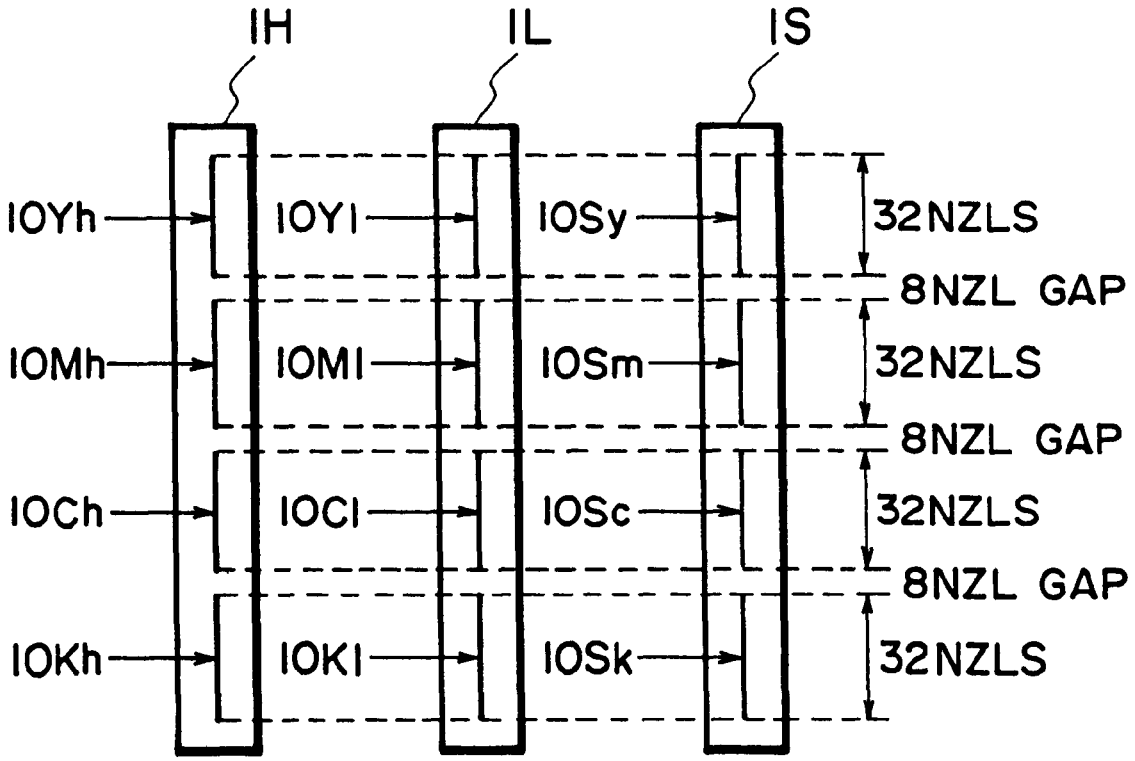
FIG. 2 shows a nozzle structure of a recording head used in the printer of FIG. 1.

FIG. 2 shows the structure of the ejection outlet of the recording head used in the printer of FIG. 1. It comprises arrays of ejection outlets 10Yh, 10Mh, 10Ch, and 10Kh for the dark ink jet recording head 1H, arrays of ejection outlets 10Yl, 10Ml, 10Cl, 10Kl for light ink recording head 1L, arrays of ejection outlets 10Sy, 10Sm, 10Sc and 10Sk for the improvement liquid recording heads 1S. Designated by 10Yh, 10Mh, 10Ch, 10Kh are ejection outlet arrays for ejecting high density yellow, magenta, cyan and black inks; 10Y1, 10Ml, 10Cl, 10Kl are arrays of ejection outlets for ejecting light (low density) yellow, magenta, cyan and black inks; and 10Sy, 10Sm, 10Sc, 10Sk are ejection outlet arrays for ejecting record improving liquid corresponding to the ejection outlets for ejecting the yellow, magenta, cyan and black inks. The ejection outlets of the recording heads 1H, 1L, 1S comprise 32 ejection outlets, respectively. The arrays of different inks are spaced with a gap corresponding to 8 ejection outlets. From the ejection outlets of the recording heads 1H, 1L and 1S, 40 ng ink or recording liquid is ejected per one recording action.

Figure 3:
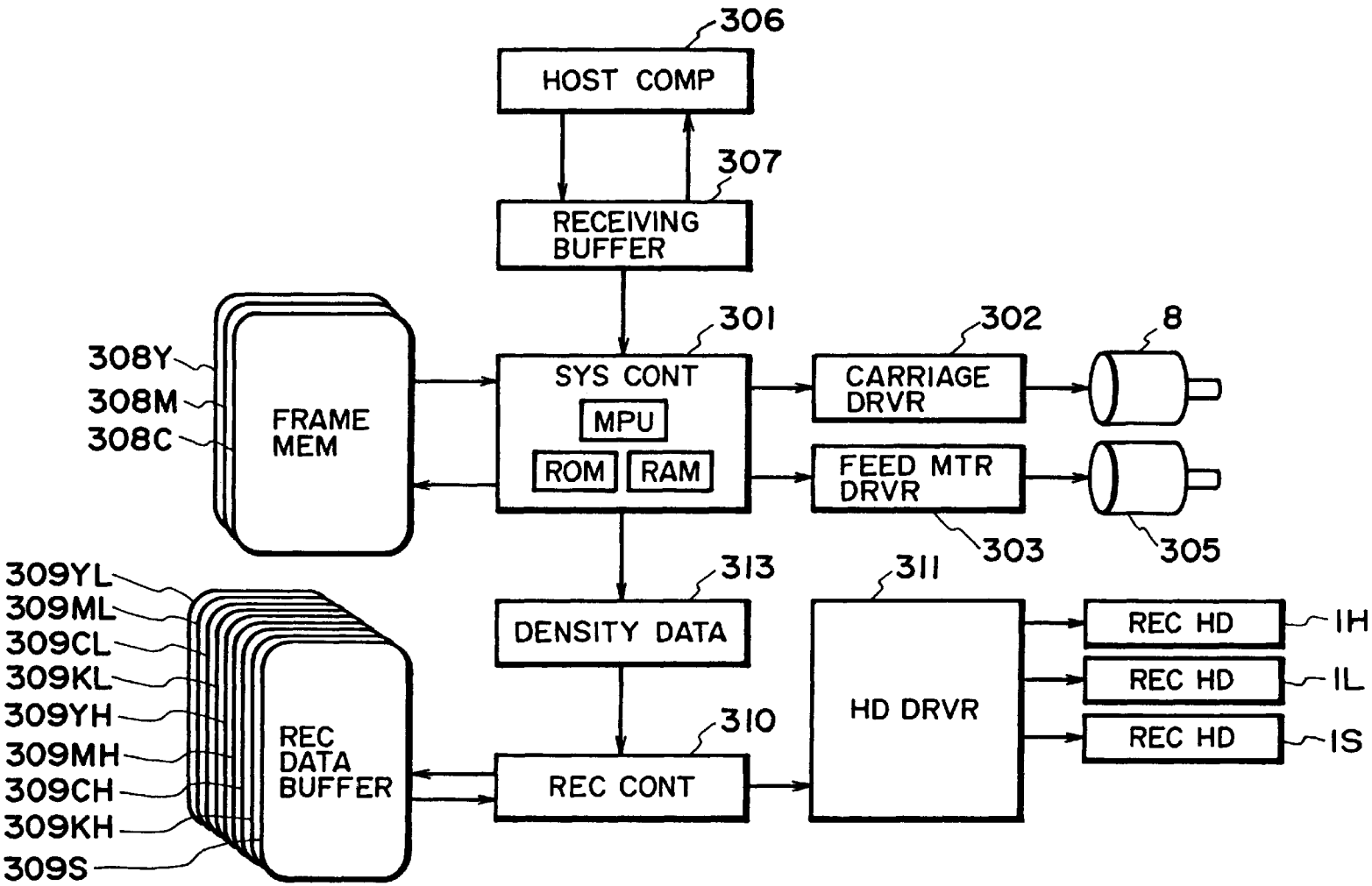
FIG. 3 is a block diagram of a control circuit for the printer of FIG. 1.

FIG. 3 is a block diagram of a control circuit for the printer of FIG. 1. It comprises a system controller 301 for controlling the entirety of the apparatus, and the controller 301 comprises an MPU, ROM for storing control program, and RAM or the like as a working area for executing various processing. It further comprises a carriage motor driver 302 for controlling a carriage motor 8 for moving the carriage carrying the recording head 1 in the main scan direction, a feeding motor driver 303 for feeding the recording sheet in the sub-scan direction. Designated by 305 is a feeding motor driven by the driver 303. The carriage motor 8 and the feeding motor 305 are operated in accordance with the speed and the moving distance supplied from the respective drivers.

A host computer 306 generates image information and supplies it to the printer. A receiving buffer 307 functions to temporarily store the image information from the host computer 306. It stores the data until the system controller 301 reads the image information in. A frame memory 308 functions to convert the image information data to image data and has a memory size sufficient for the recording. In this embodiment, the information required for recording on one recording sheet can be stored. However, the present invention is not limited to this memory size. The frame memory 308 is constituted by three parts for storing respective image data for the density data for three colors (Y, M, C), more particularly, a frame memory 308Y for storing Y component data, a frame memory 308M for M component and a frame memory 308C for C component.

A dark-light data generator 313 reads the image data out of the frame memory 308 to convert the data to the record data for the dark and light inks in accordance with the instruction from the system controller 301.

A record data buffer 309 for temporarily storing the data to be recorded comprises record data buffers 308YH, 309MH, 309CH and 309KH for storing the record data corresponding to the pixels formed by the ink ejected from the ejection outlet arrays 10Yh, 10Mh, 10Ch and 10Kh of the recording head 1H, record data buffers 309YL, 309ML, 309CL and 309KL for storing record data corresponding to pixels formed by the inks ejected from ejection outlet arrays 10Yl, 10Ml, 10Cl and 10Kl of the recording head 1L, and record data buffers 309S for storing data corresponding to record improving liquid ejection from the ejection outlet arrays 10Sy, 10Sm, 10Sc and 10Sk of the recording head 1L.

A record controller 310 controls the recording head 1 in the ink ejection speed, the number of record data or the like in accordance with the instruction from the system controller 301 and generates data for ejecting the record improving liquid. A head driver 311 drives in accordance with the control signal from the record controller 310 the recording head 1S for ejecting the record improving liquid, the recording head 1H for ejecting the dark ink, and a recording head 1L for ejecting the light ink.

Figure 4:
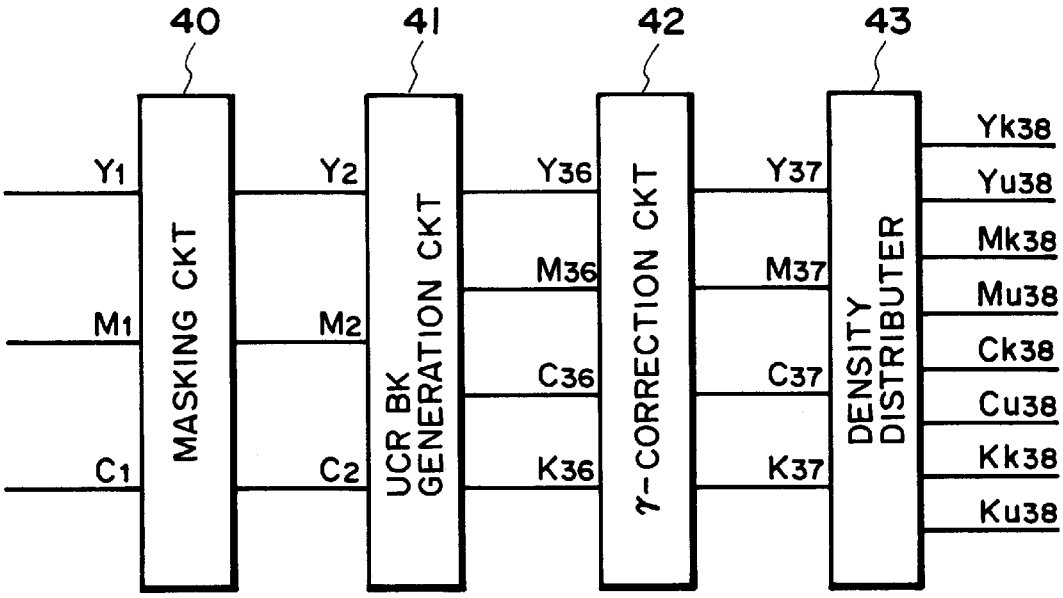
FIG. 4 is a block diagram of a light-dark data generator.

FIG. 4 is a block diagram of the dark-light data generator 313. It processes the image signals to provide tone gradation using dark and light inks.

The data Y1, M1 and C1 for each color of the density data on the basis of the input image information stored in the frame memory 307 are color-processed by a masking circuit 40, and the density data Y1, M2 and C2 obtained by the processing, are subjected to color processing by UCR-black generation circuit 41 to provide new image density signals Y36, M36, C36 and K36 for yellow, magenta, cyan and black component.

Figure 5:
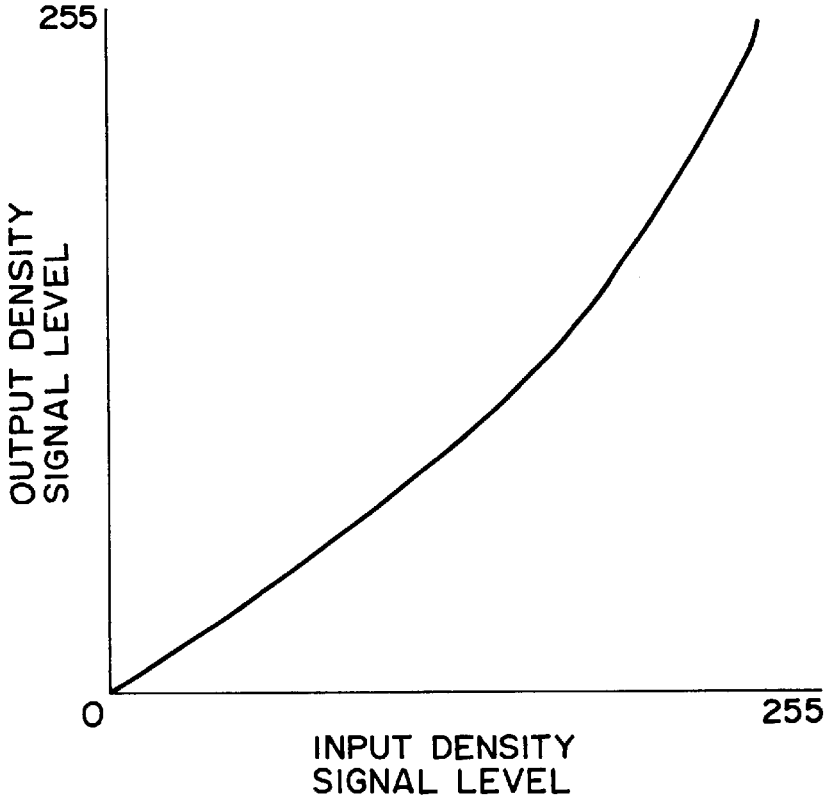
FIG. 5 illustrates gamma-correction.

The gamma-correction circuit 42 effects the gamma-correction using a gamma-correction table shown in FIG. 5 to provide image density signals Y37, M37, C37 and K37. Subsequently, a density classification circuit 43 produces image density signals Kk38, Ck38, Mk38 and Yk38 to effect the image recording using dark black ink, dark cyan ink, dark magenta ink, dark yellow ink having high dye content, in accordance with the density levels of the image density signals Y37, M37, C37 and K37, when the density level is higher than a predetermined threshold (the density is half-tone level or high level (dark portion)). On the other hand, if the density level is lower than the predetermined threshold, the density is low or intermediate, the image density signals Ku38, Cu38, Mu38 and Yu38 for effecting the image recording using the low dye content light black ink, light cyan ink, light magenta ink and light yellow ink, are produced. The image density signals by the classification process, are supplied to record data buffers 309YH, 309MH, 309CH, 309KY or 309YL, 309ML, 309CL, 309KL, as shown in FIG. 2.

Figures 6A, 6B, 6C, 6D, 6E:
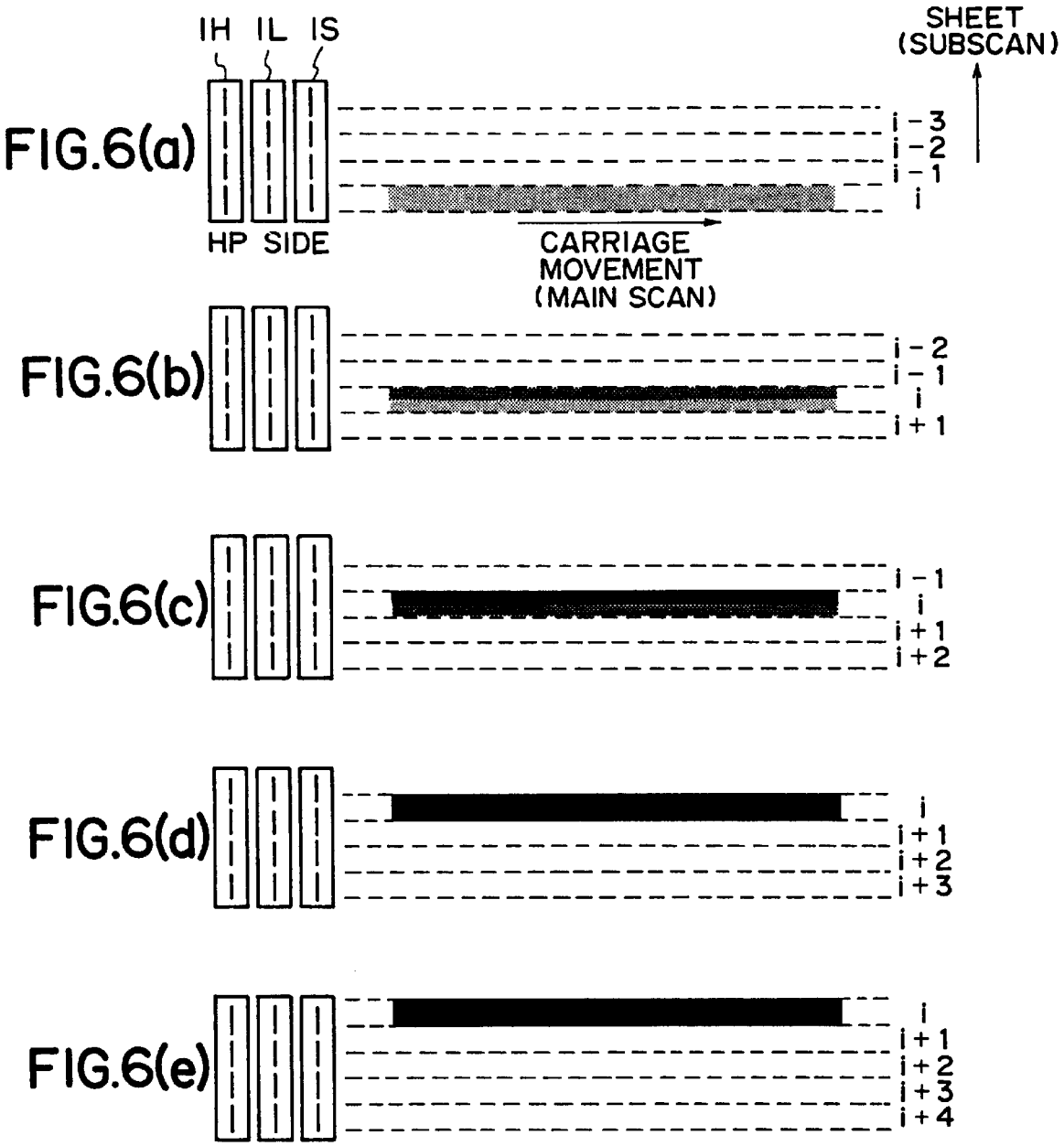
FIGS. 6(*a*)–6(*e*) illustrate a recording operation of the printer of FIG. 1.

FIGS. 6(*a*)–6(*e*) illustrates a recording operation of the printer having the structure described above, and particularly, the i-th line (one line corresponds to 32 ejection outlets) is dealt with.

As shown in FIG. 6(*a*), record improving liquid, light black ink, dark black ink are ejected on the i-th line by ejection outlets k, 10Kl and 10Kh of the recording head 1S, 1L and 1H. At this time, the recording heads 1 move in the main scan direction from the home position. Noting on a fixed position of the recording material, the record improving liquid is first deposited on the paper, and subsequently, the ink is ejected thereon. Thereafter, the recording sheet is fed by 32 ejection outlets in the sub-scan direction. As shown in FIG. 6(*b*), the record improving liquid, light cyan ink, dark cyan ink are ejected through bottom ejection outlets of the ejection outlets 10Sc, 10Cs and 10Ch of the recording heads 1S, 1L and 1H. Subsequently, the recording sheet is fed by 32 ejection outlets in the sub-scan direction. As shown in FIG. 6(*c*), the record improving liquid, light cyan ink, dark cyan ink are ejected from the top 8 ejection outlets of the ejection outlets 10Sc, 10Cl, 10Ch of the recording heads 1S, 1L and 1H, and the record improving liquid, light magenta ink, the dark magenta ink are ejected through bottom 16 ejection outlets of the ejection outlets 10Sm, 10Ml, 10Mh. Furthermore, the recording sheet is fed by 32 ejection outlets in the sub-scan direction. As shown in FIG. 6(*d*), the record improving liquid, light magenta ink and dark magenta ink are ejected through top 16 ejection outlets of the ejection outlets 10Sm, 10Ml, 10Mh of the recording head 1S, 1L and 1H, and the record improving liquid, light yellow ink, and dark yellow ink are ejected through the bottom 8 ejection outlets of the ejection outlets 10Sy, 10Yl and 10Yh.

As will be understood from the above description in conjunction with FIGS. 6(*a*)–(*e*), there are spaces corresponding to 8 ejection outlets between the groups of the nozzles for the respective inks, and therefore, five, in total, of scanning operations are required for the i-th line.

Figure 7:
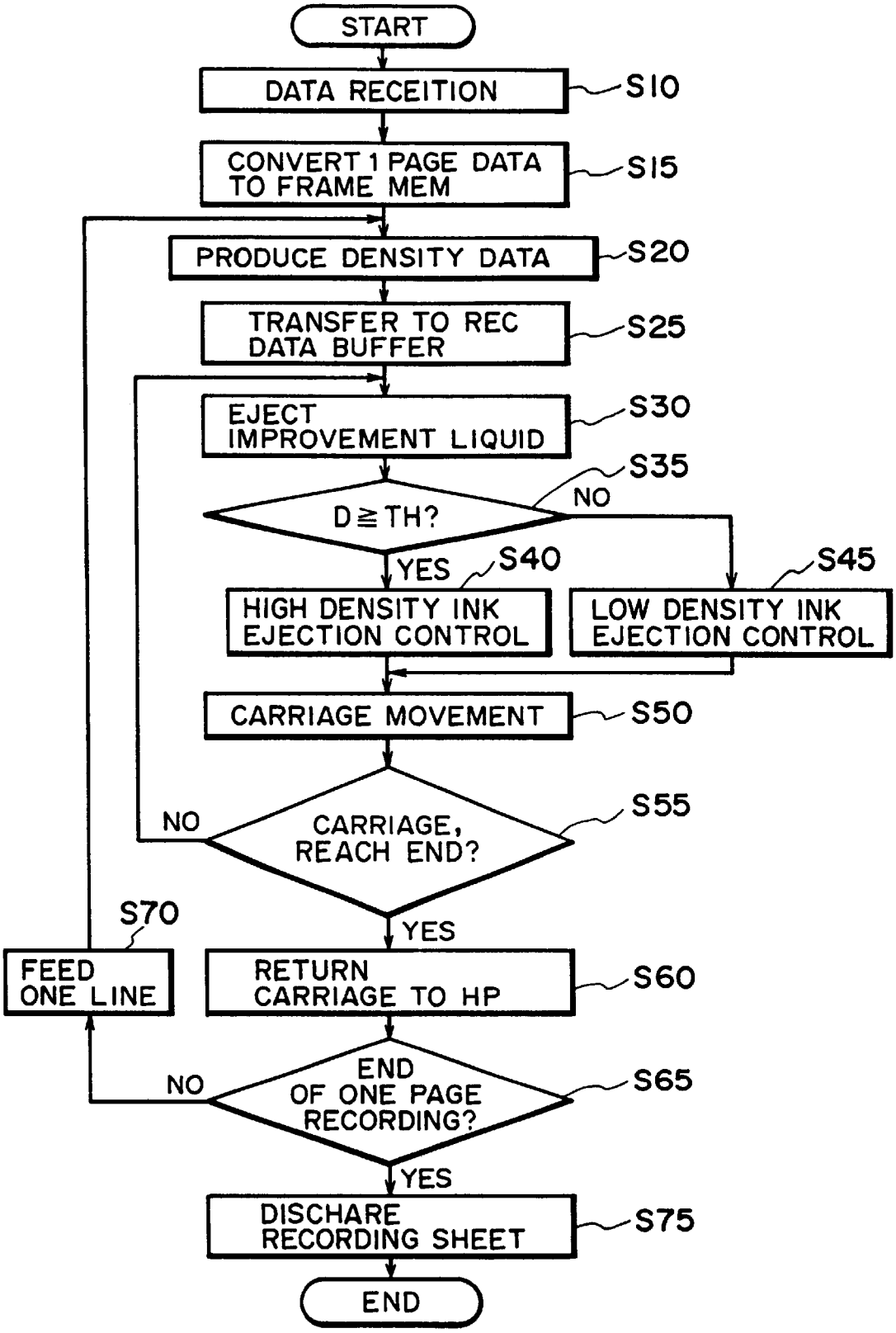
FIG. 7 is a flow chart of a recording operation of the printer.

Referring to FIG. 7, the recording operation for one page of the recording material by the printer of this embodiment will be described. Here, the record head is first positioned at the home position.

At step S10, the control circuit receives the image information from the host 306 at the receiving buffer 307. Subsequently, at step S15, the system controller 301 reads the received image information out of the receiving buffer 307, and converts it to density image data of multi-level for YMC components and supplies them to the frame memory 308.

At step S20, by the operation of the system controller 301, the dark-light data controller 313 processes the density image data of the multi-level corresponding to one line record of the recording head read out from the frame memory 308 in the manner described with FIG. 4. Thus, it produces image density signals Kk38, Ck38, Mk38, Yk38 for the image recording using the dark ink, or image density signals Ku38, Cu38, Mu38 and Yu38 for the image record using the light ink. At step S25, the image density signals thus produced are transferred to predetermined positions of the record data buffer 309 in accordance with the color components. Simultaneously, the record controller 318 generates data for the record improving liquid, and supplies it to the predetermined position of the record data buffer 309.

At step S30, the record controller 31 controls the ejection of the record improving liquid onto the recording sheet P using the recording head 1S. In the subsequent step S35, the investigation is made as to whether the level (D) of the image density signal is above a predetermined level (TH) or not. If $D \geqq TH$, the operation proceeds to step S40, where the recording head 1 is controlled, so as to eject the dark ink. If $D<TH$, the operation proceeds to step S45, where the recording head 1L is controlled to eject the light ink. After the completion in the steps S40 and S45, the operation proceeds to step S50.

In the foregoing explanation, the steps S30–S45 do not involve the difference depending on the color components, but actually, the operation shown in FIGS. 6(*a*)–6(*e*) is carried out.

At step S50, the carriage 2 is moved in the main scan direction through a small distance. At step S55, the investigation is made as to whether or not the carriage 2 reaches the end of movement. If not, the operation returns to step S35 to repeat the recording operation. If the carriage reaches the end of the moving stroke, the operation proceeds to step S60, where the carriage 2 is returned to the home position.

At step S65, the investigation is made as to whether or not the recording operation for one page is completed or not. If not, the operation proceeds to S70, where the recording sheet is fed by one line, and the operation returns to step S20. If the recording operation for one page is completed, the operation proceeds to step S75, where the recording sheet P is discharged, and the series of the operations is completed.

According to this embodiment, the record improving liquid is deposited on the recording sheet before the ejection of the ink for the record. Therefore, the deterioration of the record image quality attributable to the later ink dye dissolves on the recording sheet, and therefore, high quality color image can be provided.

The durability against water of the recorded image has been confirmed as substantially complete through experiments.

Embodiment 2

Figure 8:
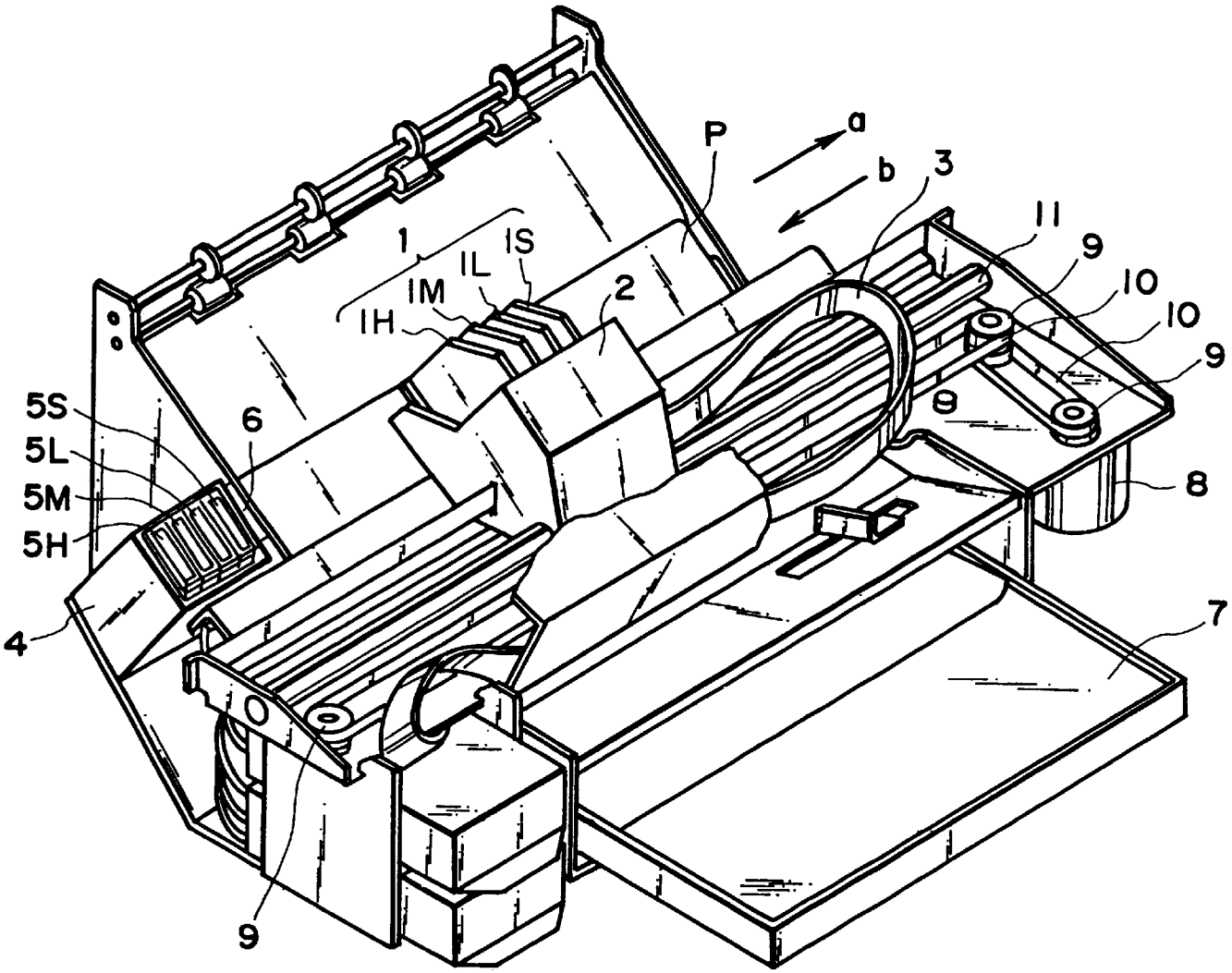
FIG. 8 is a perspective view of an outer appearance of a color printer of an ink jet type according to a second embodiment of the present invention.

FIG. 8 is a perspective view of an outer appearance of a color printer (printer) of an ink jet type according to an embodiment of the present invention. In FIG. 8, the same reference numerals as in FIG. 1 are assigned, and therefore, the detailed description thereof are omitted for simplicity.

In FIG. 8, designated by 1M is a recording head for ejecting intermediate density ink having a density between the dark ink and the light ink. By this, higher quality color image can be recorded. Designated by 5M is a capping member corresponding to the recording head 1M. The structure of the recording head 1M is the same as the recording heads 1H, 1L and 1S. It comprises yellow ink ejection outlets 10Ym, magenta ink ejection outlets 10Mm, cyan ink ejection outlets 10Cm, black ink ejection outlets 10Km similarly to the recording heads 1H, 1L and 1S.

Figure 9:
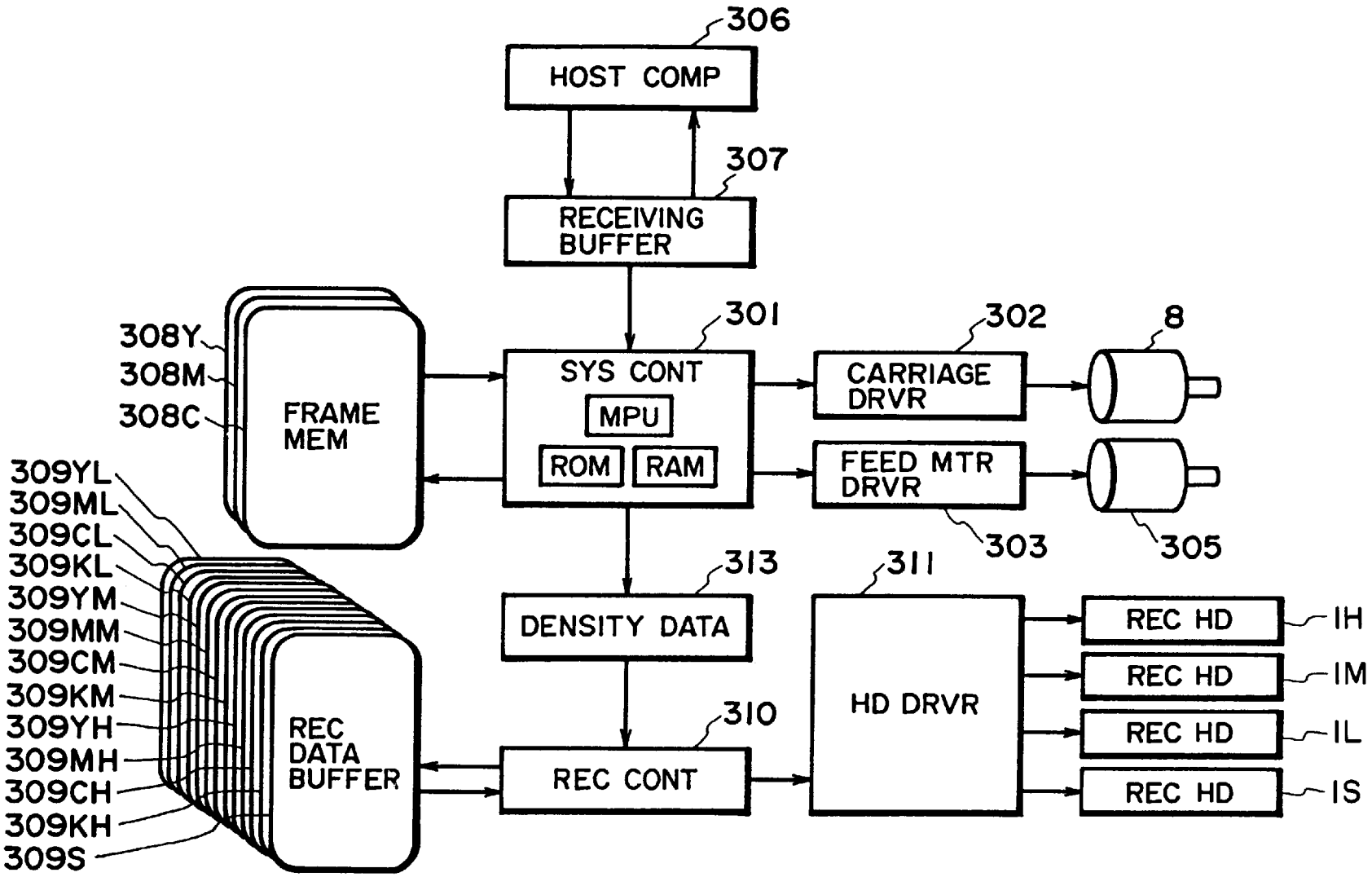
FIG. 9 is a block diagram of a control circuit of a printer of FIG. 8.

FIG. 9 is a block diagram of a control circuit for the printer of this embodiment. The same reference numerals as in FIG. 3 are assigned to the elements having the corresponding functions, and the detailed description thereof is omitted. In FIG. 9, designated by 309YM, 309MM, 309CM, 309KM are record data buffers for storing record data for the pixels to be recorded by yellow ink ejection outlets, magenta ink ejection outlets, cyan ink ejection outlets and black ink ejection outlets of the recording head 1M.

The image formation process of this embodiment is fundamentally the same as in Embodiment 1, and therefore, the detailed description thereof are omitted.

The dark ink, light ink, the record improving liquid have the same chemical compositions as shown in Tables 1, 2 and 3. The chemical composition of the intermediate density ink having the intermediate density is as shown in Table 4 on the basis of the percent by weight of the dark ink and light ink in Embodiment 1.

TABLE 4

| | Dark ink | Intermediate ink | Light ink |
|---|---|---|---|
| Yellow | 1.5 | 0.5 | 0.15 |
| Magenta | 2.5 | 0.75 | 0.35 |
| Cyan | 2.5 | 0.65 | 0.3 |
| Black | 3.0 | 0.8 | 0.4 |

The values in Table 4 are percent by weight in the ink of C.I. Direct Yellow 86, C.I. Acid Red 289, C.I. Direct Blue 199, C.I. Direct Black 154.

The dark light classification circuit of the light data generator 313 of this embodiment classifies the density data using two threshold levels for each color component. The high density data is recorded by dark ink, and the data are transferred to a record data buffer 309YH, 309MH, 309CH and 309KH. The intermediate density data are recorded by intermediate ink, and the data therefore are transferred to the record data buffers 309YK, 309MM, 309CM and 309KM. The low density data are recorded by light ink, and the data therefore are transferred to a data buffer 309YL, 309ML, 309CL and 309KL.

Thus, according to this embodiment, the image recording further uses proper density inks in accordance with the density of the input image data, and therefore, smooth tone gradation and clear high quality image can be provided without ink smearing at the boundary between different inks.

Embodiment 3

Figure 10:
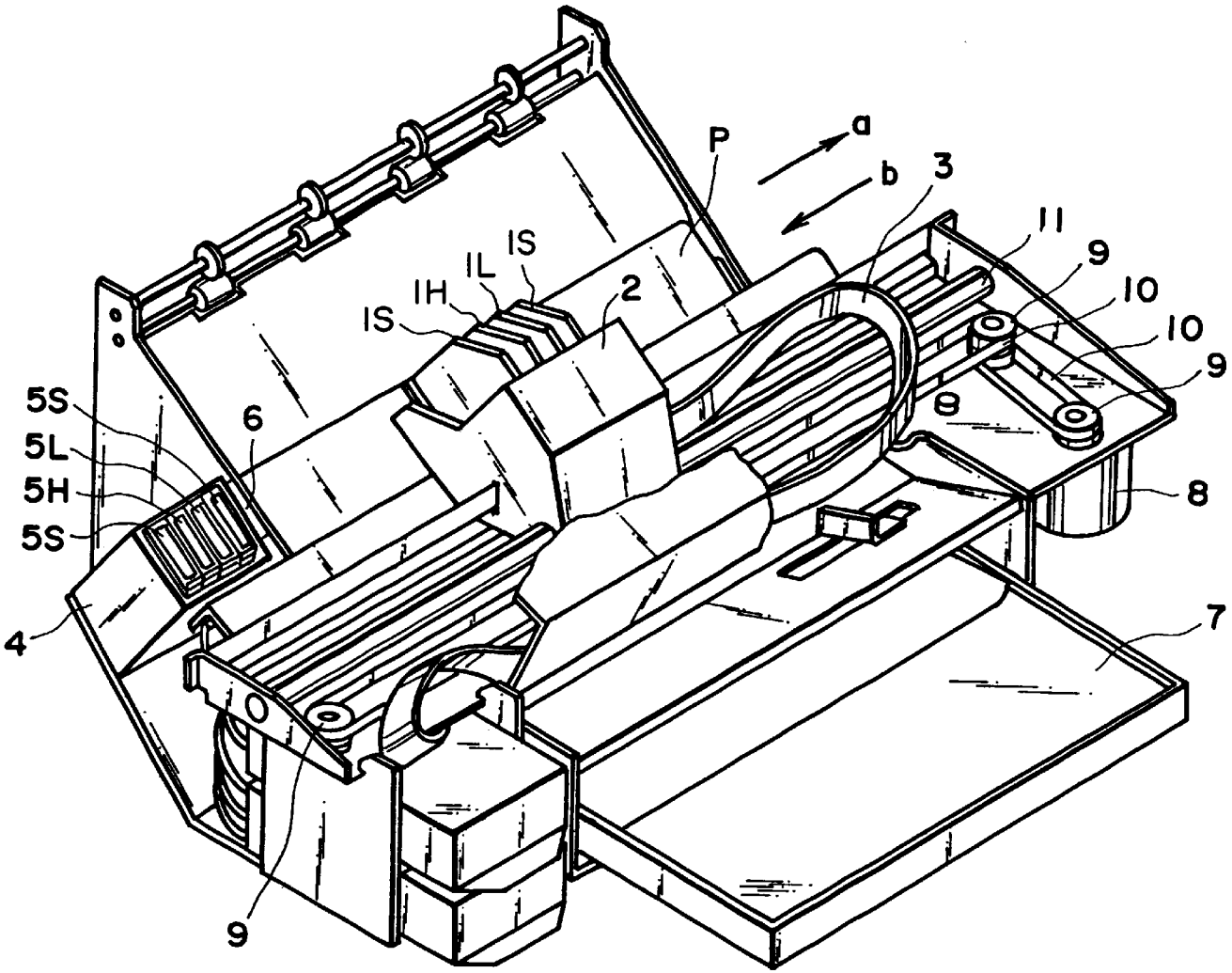
FIG. 10 is a perspective view of an outer appearance of a color printer of an ink jet type according to a third embodiment of the present invention.

In Embodiment 1, only one recording head for the record improving liquid is used. In this embodiment, one additional recording head for ejecting the record improving liquid is used as shown in FIG. 10 to permit the operation in the reciprocating strokes in the main scan direction of the recording head. As shown in FIG. 10, the recording head for ejecting the record improving liquid are provided at both sides of the recording heads 1H and 1L.

With this structure, the record improving liquid can be ejected before the recording ink ejection irrespective of whether the carriage 2 is moving in a direction a or direction b. Therefore, the high quality color image can be provided high speed serial printing operation without color non-uniformity.

Embodiment 4

Figure 11:
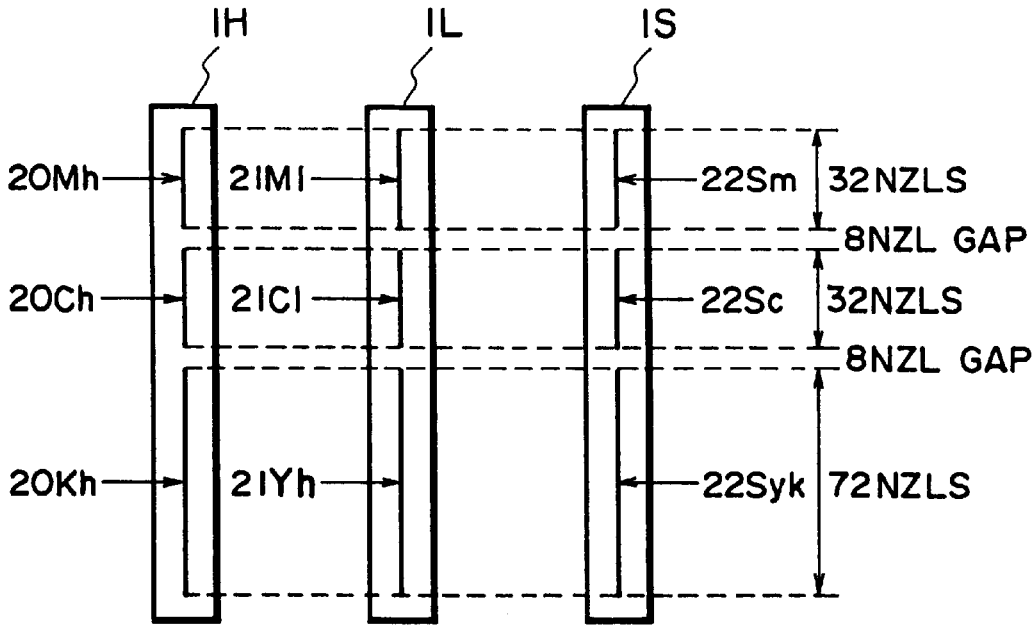
FIG. 11 shows nozzle structures of recording heads according to a fourth embodiment of the present invention.

FIG. 11 shows the structure of the ejection outlet of the recording heads 1H, 1L and 1S according to this embodiment.

The recording head 1H has an array of ejection outlets 20Mh for ejecting dark magenta ink, an array of ejection outlets 20Ch for ejecting dark cyan ink, an array of ejection outlets 20Kh for ejecting dark black ink. The ejection outlet arrays 20Mh, 20Ch have 32 ejection outlets, and ejection outlet array 20Kh has 72 (=38+3+32) ejection outlets, and spaces (gaps) corresponding to 8 ejection outlets are provided between ejection outlet arrays.

The recording head 1L is provided with an array of ejection outlets 21Ml for ejecting light magenta ink, an array of ejection outlets 21Cl for ejecting light cyan ink, an array of ejection outlets 21Yh for ejecting dark yellow ink. The numbers of ejection outlets 21Ml, 21Cl, 21Yh, and the numbers of are 32, 32 and 72, respectively, with the spaces corresponding to 8 ejection outlets between the adjacent arrays.

The recording head 1S comprises an array of ejection outlets 22Sm, 22Sc, 22Syk for ejecting the record improving liquid, and the respective arrays have 32, 32 and 72 ejection outlets, and spaces corresponding to 8 ejection outlets are provided between adjacent arrays.

For the yellow ink, only the ejection outlets for ejecting the dark ink, are provided, and for the black ink, only the ejection outlets for ejecting the dark ink are provided. The yellow ink has high lightness, and the recording dots are not conspicuous on the record image, and therefore, the dark yellow ink is usable. As to the black ink, it is used for high density portion only, and therefore, the dots are not conspicuous, and therefore, dark ink is usable.

Additionally, with the recording head of this embodiment, there are provided a greater number of ejection outlets for ejecting the yellow and black inks.

Accordingly, with this embodiment, when the record is effected only using black ink, the recording speed can be improved. If the comparison is made with Embodiment 1, the number of the ejection outlets for ejecting the black ink is twice as many, and therefore, approximately twice the recording speed is ccomplished when monochromatic image is recorded. hen the color image is to be recorded, the magenta and cyan ink include dark ink and light ink, respectively, and therefore, a high quality image is still possible, comparable to the first embodiment.

In the foregoing embodiments, the present invention is not limited to these specific structures.

For example, in Embodiment 3, the record improving liquid heads are provided at both sides of the recording heads lH for the dark ink and the light ink. However, the record improving liquid head 1S in Embodiment 1 may be displaced toward upstream with respect to the feeding direction of the recording sheet, so that the record improving liquid can be ejected before the ejection of the recording ink both in the forward and backward strokes of the recording head, so that the similar advantageous effects as Embodiment 3 can be provided.

In Embodiments 1 and 2, the specific chemical compositions are provided for the dark and light inks in Embodiment 1, and dark, intermediate and light inks in Embodiment 3. The present invention is not limited to this. For example, four or more different density inks are usable, and the density of the ink may be changed depending on the characteristics of the output images. Furthermore, the ink densities may be changed for each ink.

A plurality of ejection outlets for ejecting different color inks may be formed in one recording head, or a plurality of recording heads which are independent for each ejection outlet, is usable.

As shown in FIG. 2, the arrays of the ejection outlets for ejecting different color inks are arranged on a line as in recording head 1H. As shown in FIGS. 12(*a*) and 12(*b*), the recording head 1H may have staggeredly arranged ejection outlet arrays 10Yh, 10Mh, 10Ch and 10Kh.

In FIG. 2, the gap between the ejection outlet arrays corresponds to 8 ejection outlets. The gap is not required if the manufacturing is possible.

Figure 13:
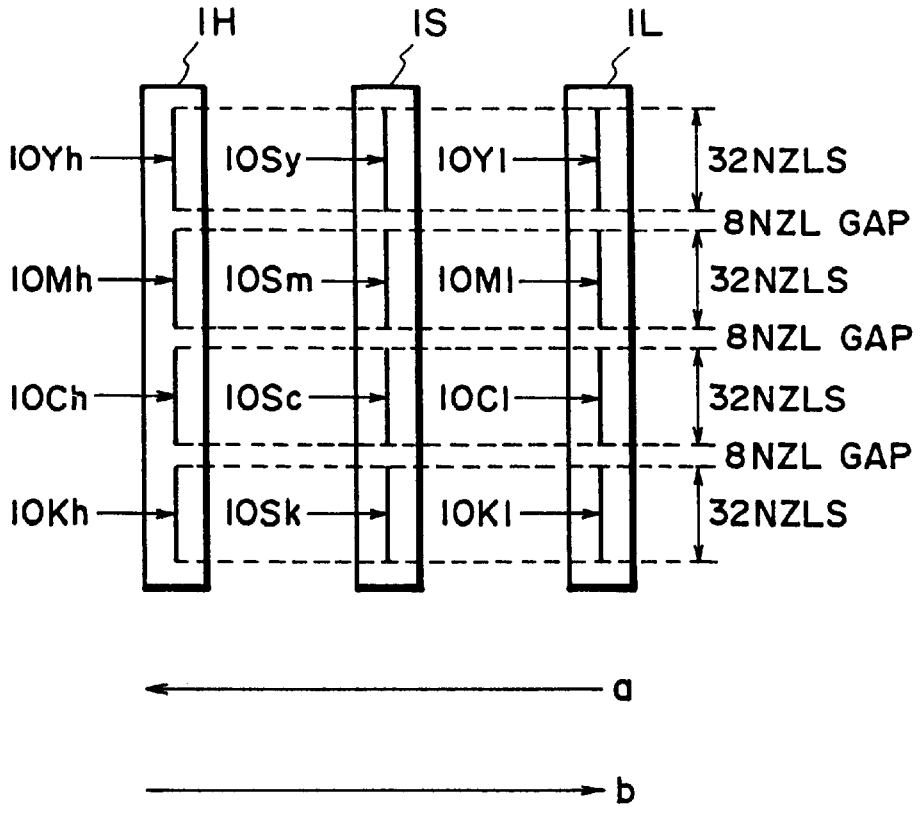
FIG. 13 shows a further example of the structure of the recording head.

In FIG. 2, the recording head 1S for the record improving liquid ejection is disposed at an end in the main scan direction. This is not limiting, it may be disposed at the center between the dark ink ejection head 1H and a light ink ejection head 1L as shown in FIG. 13. With the structure shown in FIG. 2, when the recording speed is high, the recording heads 1H, 1L and 1S (3 recording heads) are required to be simultaneously driven if the record improving liquid is ejected prior to the record ink ejection. This results in power consumption. On the other hand, if the structure of FIG. 13 is used, two recording heads, namely, the recording head 1S and the recording head 1L are driven when the recording head is moved in the main scan direction a, and the two recording heads 1S and 1H are driven when it is moved in the main scan direction b. Thus, the power consumption can be saved, and the cost of the recording apparatus can be reduced. As a modification of FIG. 13 structure, the recording head 1L is detachably mountable, and a recording head 1H for ejecting the dark ink which is the same as that of the recording head 1H is used in place of the recording head 1L. In the main scan in the direction a, the recording head 1S and the left hand recording head 1H are driven. In the main scan in the direction b, the recording head 1S and the right recording head 1H are driven to permit reciprocal recording. By doing so, the throughput of the normal color recording can be improved. When a higher quality color image is desired, the right hand recording head 1H is removed, and a right ink ejection head 1L is mounted to effect the dark-light recording, thus improving the image quality. In this case, in place of replacing the light hand recording head in FIG. 13, the ink container for the recording head may be both of dark and light inks to selectively used depending on the image desired.

Figure 14:
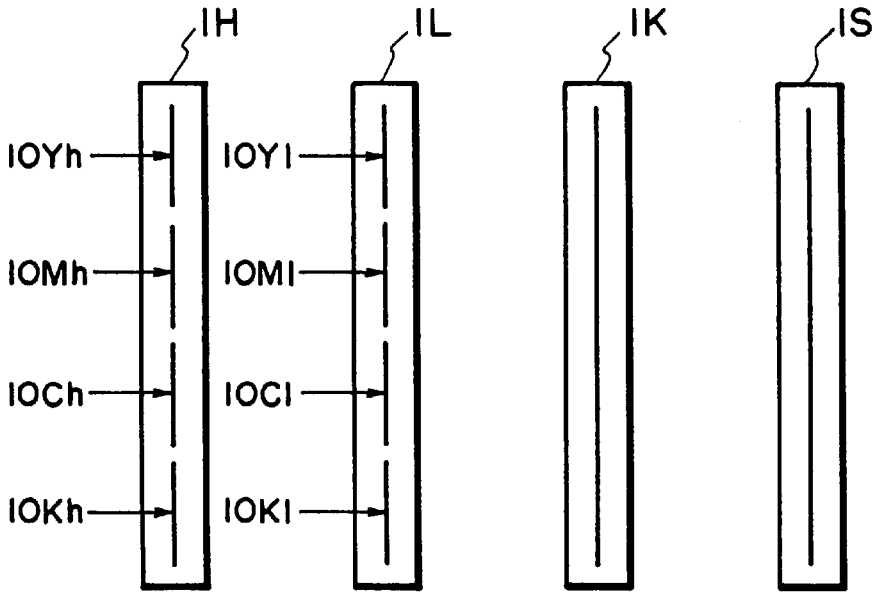
FIG. 14 illustrates a further example of a structure of the recording head.

FIG. 14 shows another example of the recording head. In FIG. 14, the recording head 1H for ejecting the dark ink, the recording head 1L for ejecting the light ink, the recording head 1K for ejecting only the black ink, and the recording head 1L for ejecting only the recording improving liquid, are arranged in FIG. 14. The ejection outlet arrays of the recording head 1H and the recording head 1S are not divided as in the recording heads 1H or 1L. By doing so, when only black image is recorded, only the recording heads 1K and 1S are used, so that one scanning operation is enough to effect the record of the length of the ejection outlet arrays of the recording heads 1K and 1S, thus permitting high speed recording. In this case, for the recording heads 1H and 1L, the same ink as in Embodiment 1 is used, and on the other hand, for the recording head 1K, the high density black ink is used as used for the ejection outlet array 10Kh of the recording head 1H. The quantity of the ink per ejection from the ejection outlets of the recording head 1K is larger than the quantity of the ink per ejection from the ejection outlet array 10Kh in order to provide the high quality image by increasing the black image density (characters), for example, 60–80 ng/ejection.

In the foregoing embodiment, the dye ink is used. However, the present invention is not limited to this. For example, pigment ink is usable. The following is an example of the pigment ink.

(1) Black Ink

Anion high polymer P-1 (a water solution of styrene-methacryl acid-ethylacrylate having acid number of 400, weight average molecular weight of 6000 and solid component of 20% with neutralizing material of potassium hydroxide) is used as a dispersing material. It is placed in batch type vertical sand mill (available from Imex), and glass beads of diameter 1 mm are filled. Dispersion process is carried out for 3 hours with water cooling. The viscosity after the dispersion was 9 cps, and pH is 10.0. The liquid is subjected to a centrifugal separator to remove large particles, thus producing carbon black dispersion having a weight average particle size of 100 nm. The composition of the dispersion is shown in Table 5. They are sufficiently stirred to provide black ink containing pigments. The solid content of the final products was approximately 10%.

TABLE 5

| Ingredient | Dark (wt. %) | Light (wt. %) |
|---|---|---|
| P-1 aqueous solutoin (solid content of 20%) | 18.4 | 18.4 |
| Carbon black Mogul L (available from Cablach, Inc.) | 11.0 | 1.4 |
| Glycerin | 6.9 | 6.9 |
| Ethyleneglycol monobutylether | 0.2 | 0.2 |
| Isoprapyl alcohol | 1.4 | 1.4 |
| Water | 62.1 | 71.7 |

(2) Yellow Ink

Anion high polymer P-2 (water solution of styrene-acrylic acid-methylmethacrylate having acid number of 280, weight average molecular weight of 11000, solid content of 20% with neutralizing material of dietanolamine) is used as a dispersing material. Similarly to the case of the black ink, the dispersion process is carried out to provide yellow dispersion having a weight average particle size of 103 nm. The chemical component thereof is shown in Table 6. The dispersion is sufficiently stirred to provide the yellow ink containing the pigment, the solid content of the final product was approximately 10%.

TABLE 6

| Ingredient | Dark (wt. %) | Light (wt. %) |
|---|---|---|
| P-2 Aqueous solution (solid content of 20%) | 16.2 | 16.2 |
| C.I. Pigment Yellow 180 (Novavame Yellow PH-G available from Hoechst) | 11.1 | 0.7 |
| Triethyleneglycol | 4.7 | 4.7 |
| Diethyleneglycol | 4.7 | 4.7 |
| Ethyleneglycol monobutylether | 0.5 | 0.5 |
| Isopropyl alcohol | 0.2 | 0.2 |
| Water | 62.6 | 73.0 |

(3) Cyan Ink

The anion high polymer P-1 used in the black ink is used as the dispersing material, and the some dispersion process as in the black ink is carried out to provide cyan dispersion of the weight average particle size of 120 nm. The composition thereof is shown in Table 7. The dispersion is sufficiently stirred to provide cyan ink containing pigments. The solid component of the final product was approximately 9.6%.

TABLE 7

| Ingredient | Dark (wt. %) | Light (wt. %) |
|---|---|---|
| P-1 Aqueous solution (solid content of 20%) | 14.5 | 14.5 |
| C.I. Pigment Blue 15:3 (available from Dainippon Ink Kagaku K.K.) | 11.6 | 1.2 |
| Glycerin | 7.2 | 7.2 |
| Diethyleneglycol monobutylether | 0.2 | 0.2 |
| Isopropyl alcohol | 1.4 | 1.4 |
| Water | 65.1 | 75.5 |

(4) Magenta Ink

The some anion high polymer P-1 is used in the black ink was used as the dispersing material. The same dispersing process was carried out to provide magenta dispersion having a weight average particle size of 115 nm. The chemical composition thereof is shown in Table 8. The dispersion is sufficiently stirred to provide magenta ink for the ink jet, containing pigments. The solid content of the final product was approximately 9.2%.

TABLE 8

| Ingredient | Dark (wt. %) | Light (wt. %) |
|---|---|---|
| P-1 Aqueous solution (solid content of 20%) | 10.2 | 10.2 |
| C.I. Pigment Red 122 (available from Dainippon Ink Kagaku K.K.) | 12.2 | 1.5 |
| Glycerin | 7.6 | 7.6 |

TABLE 8-continued

| Ingredient | Dark (wt. %) | Light (wt. %) |
|---|---|---|
| Isopropyl alcohol | 1.5 | 1.5 |
| Water | 68.5 | 79.2 |

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink Jet recording apparatus may be used as an output terminal of an information processing apparatus such as computer or the like, as a copying apparatus combined with an image reader or the like, or as a facsimile machine having information sending and receiving functions.

The present invention is applicable to a system including a plurality of devices. The present invention may be used by incorporating a program to a system or device.

Figure 15:
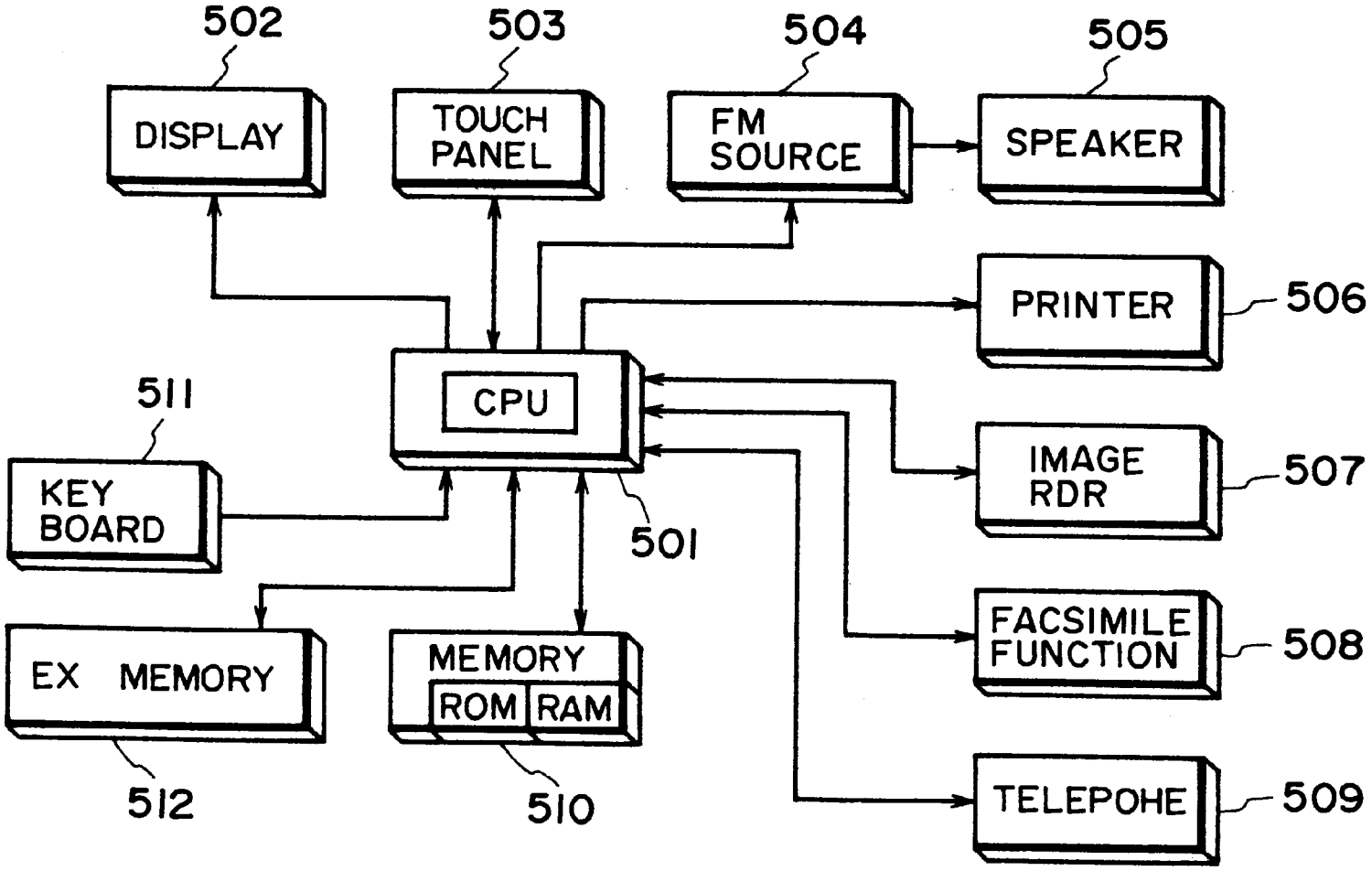
FIG. 15 is a block diagram of an information processing apparatus using the recording apparatus of the present invention.

FIG. 15 is a block diagram of an image information apparatus having functions of word processor, personal computer, facsimile machine, copying machine, electronic typewriter or the like using the recording apparatus of this invention. In this Figure, designated by 501 is a controller for controlling the entire apparatus and comprises a CPU such as microprocessor and various I/O ports to output control signals and data signals or the like, and receives various control signals and data signals. Designated by 502 is a monitor which displays various menus, document information, image data read by an image reader 507 or the like. Designated by 503 is a pressure-sensitive type touch panel which is transparent on the display 502. By pressing the surface by finger or the like, input on the display is possible.

Designated by 504 is an FM (Frequency Modulation) sound source, and it stores as digital data in memory 510 or external memory 512 sound information produced by music editor or the like. The data are read out of the memory, and FM modulation is effected. The electric signals from the FM sound source 504 are converted by a speaker 502 to audible sounds. The printer 506 functions as output terminals of the word processor, personal computer, facsimile machine, copying machine, electronic typewriter or like functions, and has the structure described in the foregoing embodiments.

Designated by 507 is an image reader for photoelectrically reading the image data. It is placed in the original feeding path, and reads the facsimile original, copy original or various originals. A facsimile station 508 functions to send facsimile signals from the original data read by image reader 507 or the like and to decoding the signals received. It functions as an interface. Designated by 509 is a telephone set having various telephone functions. Designated by 510 is a memory including ROM for storing system program, manager program, other application program or the like, character font, dictionaries or the like, RAM or the like for storing application program loaded from an external memory 512 or character information or video information.

Designated by 511 is a keyboard for receiving document information or various commands. Designated by 512 is an external memory in the form of a floppy disk, hard disk or another recording medium. The external memory device 512 stores character information, music, sound information or application program of user.

Figure 16:
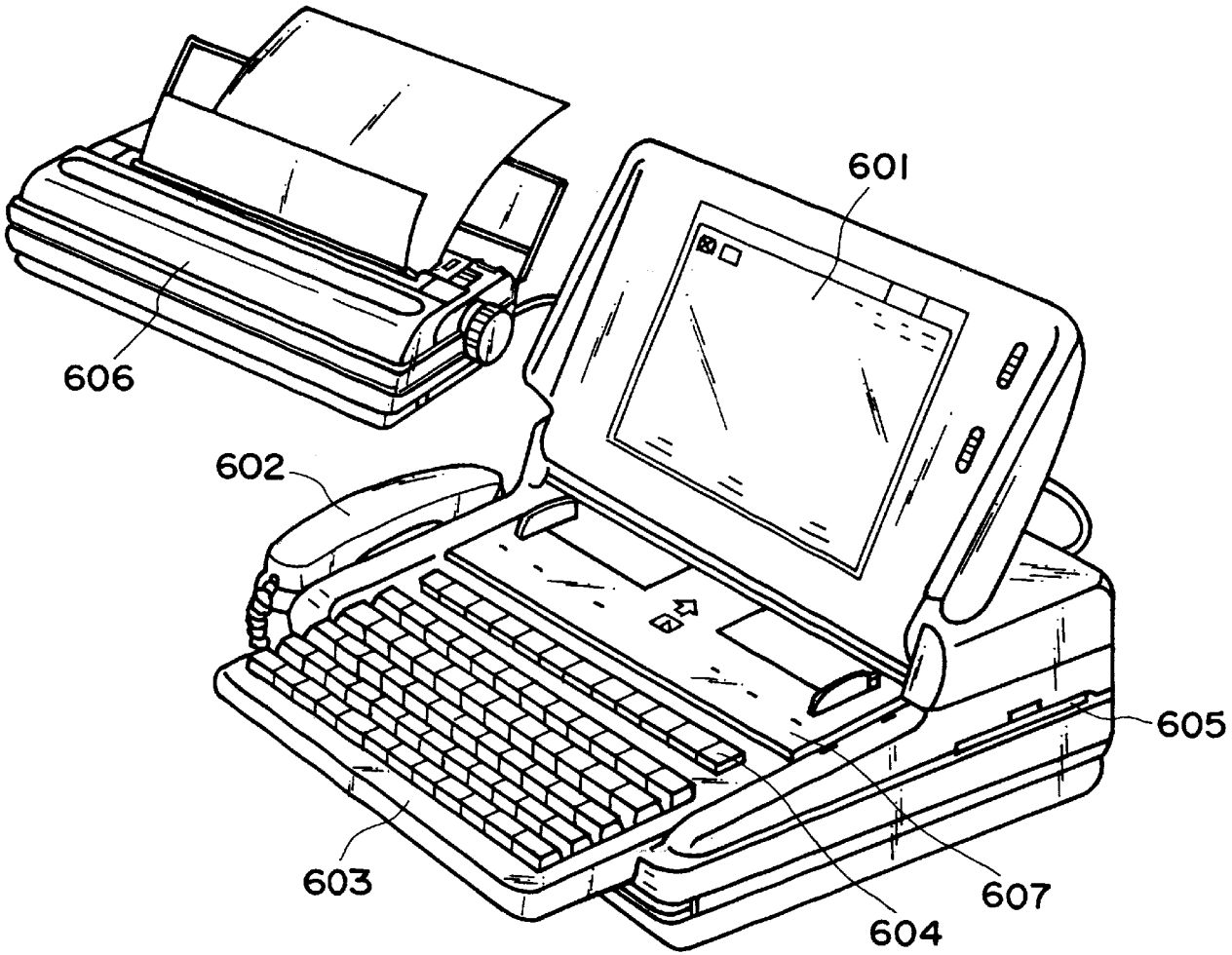
FIG. 16 shows an outer appearance of an example of information processing apparatus of FIG. 15.

FIG. 16 is an outer appearance of information processing apparatus. Designated by 601 is a flat panel display of liquid crystal and displays various menus, graphic information and document information. On the display 601, a touch panel is mounted. By pressing the touch panel by a finger or the like, the item or coordinate input is possible. Designated by 602 is a hand set in the telephone function.

The keyboard 603 is detachably connected with the main assembly through wiring to permit various document information and data input. The keyboard 603 is provided with various function keys 604, or the like. The floppy disk is inserted through an opening 605.

Designated by 607 is an original support for supporting an original to be read by an image reader 607, and the read original is discharged to the rear of the apparatus. When the information is received by facsimile function, it is printed out by a printer 607.

The monitor 601 may be of CRT, but flat panel such as liquid crystal display using FLC because the downsizing and thin structure with light weight property. When the information processing apparatus is used as a personal computer or word processor, the various information inputted by the keyboard 511 in FIG. 15 is processed by a predetermined program by a controller 501, and it is outputted to a printer 506 as an image. When it functions as a receptor of the facsimile machine, the facsimile information inputted through the facsimile receiver 508 is processed by a predetermined program by the controller 501, and is outputted as an image by the printer 506.

Figure 17:
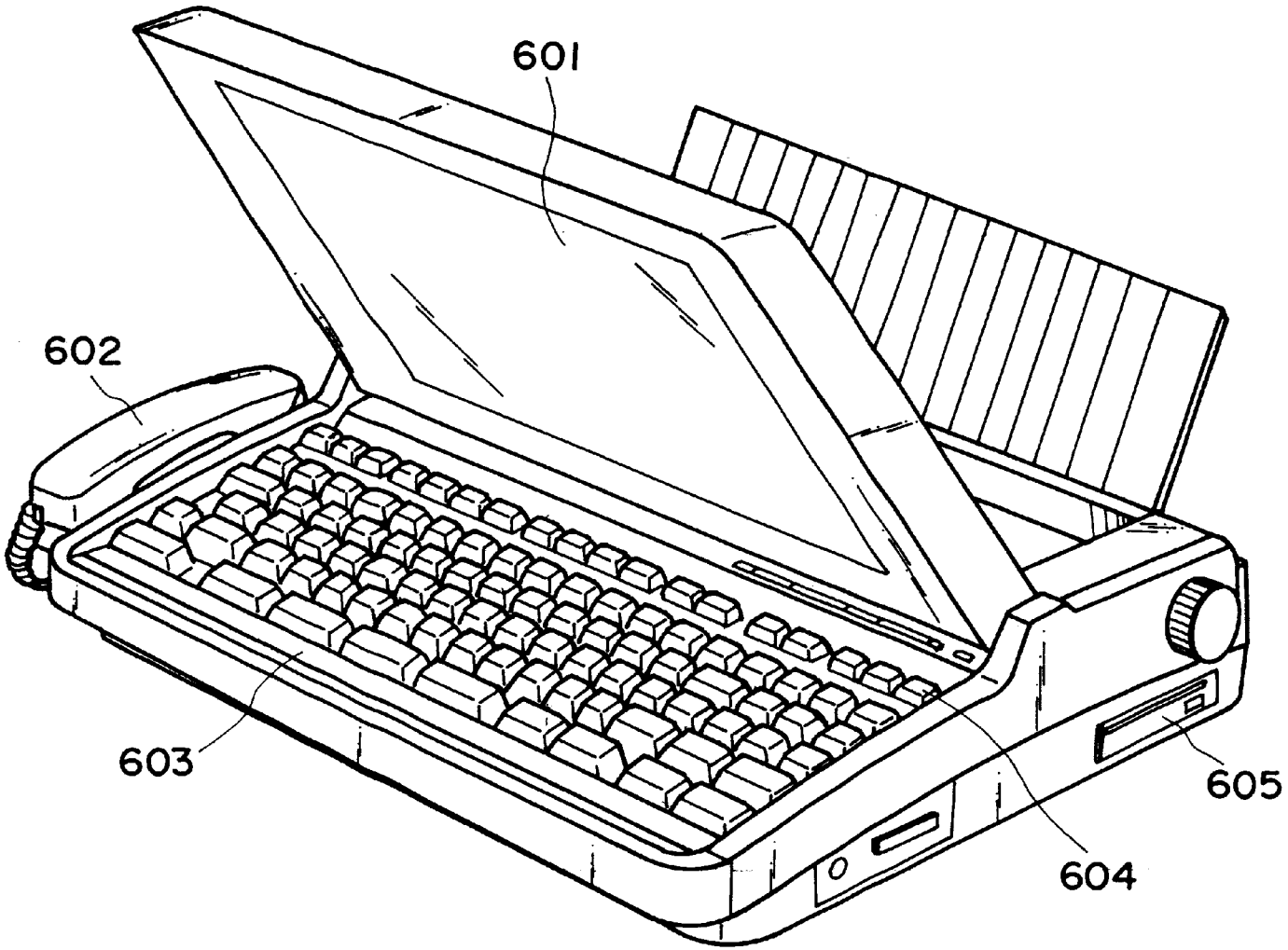
FIG. 17 shows an outer appearance of another example of information processing apparatus.

When it functions as a copying machine, the original is read by an image reader 507, and the data of the original image thus read is outputted as a copy image by a printer 506 through the controller 501. When it functions as a sender of the facsimile function, the data of the original read by the image reader 507 is processed by a predetermined program by the controller 501, and then, it is outputted by a facsimile sender 501 to a communication line. The information processing apparatus may have the printer as a unit as shown in FIG. 17. In this case, the apparatus is more easily transportable. The same reference numerals as in FIG. 16 are assigned to the corresponding functions.

By the application of the recording apparatus of this invention to the multi-function information processing apparatus, the function of the information processing is further improved.

As described in the foregoing, according to the present invention, even if some abnormality occurs, the image data to be supplied to the abnormal recording elements can be supplied to the other recording elements to compensate for the malfunction, thus providing desired image.

As described in the foregoing, according to the present invention, the coloring material does not smear into the other color ink, and the high tone gradation printing is possible.

While the invention has been described with reference to the structures disclosed herein, it is not confined to the details set forth and this application is intended to cover such modifications or changes as may come within the purposes of the improvements or the scope of the following claims.

What is claimed is:

1. A recording head assembly for ejecting ink to effect recording on a recording material while moving in a main scanning direction relative to the recording material, comprising:

a first group of ejection outlet blocks including a plurality of election outlets arranged substantially in a subscan direction, which is different from the main scanning direction, for ejecting record improving liquid for improving record property on the recording material, the record improving liquid including at least one agent for making coloring material in the ink insoluble or coagulated;

a second group of ejection outlet blocks arranged substantially in the subscan direction, each of said ejection outlet blocks in the second group including a plurality of ejection outlets arranged substantially in the subscan direction, said ejection outlet blocks in the second group being effective to eject through the ejection outlets therein first inks of different colors having first densities, respectively; and a third group of ejection outlet blocks arranged substantially in the subscan direction, each of said ejection outlet blocks in the third group including a plurality of ejection outlets arranged substantially in the subscan direction, said ejection outlet blocks in the third group being effective to eject through the ejection outlets therein second inks of different colors, the second inks having the same colors as the first inks, respectively, and the second inks having second densities which are lower than the first densities, respectively, wherein said first group of ejection outlet blocks, said second group of ejection outlet blocks and said third group of ejection outlet blocks are disposed in said recording head assembly and arranged side by side in a predetermined order in the main scanning direction, and said first group of ejection outlet blocks is disposed at an upstream side position with respect to the main scanning direction and said second group of ejection outlet blocks and said third group of ejection outlet blocks are disposed at a downstream side position with respect to the main scanning direction such that the record improving liquid is first ejected on the recording material and subsequently the inks are ejected thereon when recording is performed.

2. A recording head assembly according to claim 1, further comprising thermal energy generating means for generating thermal energy for the ink or the record improving liquid.

3. Arecording head assembly according to claim 1, further comprising a fourth group of ejection outlet blocks, each ejection outlet block of said fourth group including a plurality of outlets arranged substantially in the subscan direction, for ejecting third inks having third densities which are between the first and second densities.

4. A recording head assembly according to claim 1, further comprising an additional group of ejection outlet blocks, wherein said first group of ejection outlet blocks and said additional group of ejection outlet blocks are disposed on either side of said second group of ejection outlet blocks and said third group of ejection outlet blocks.

5. A recording head assembly according to claim 1, wherein the first inks of different colors and the second inks of different colors include yellow, magenta, cyan and black inks, and said second group of ejection outlet blocks ejects magenta, cyan and black inks, and said third group of ejection outlet blocks ejects magenta, cyan and yellow inks.

6. A recording head assembly according to claim 1, wherein said first group of election outlet blocks, said third group of election outlet blocks and said second group of election outlet blocks are arranged as listed in the main scanning direction.

7. A recording head assembly according to claim 1, wherein the first inks of different colors and the second inks of different colors include yellow, magenta and cyan inks, said second group of ejection outlet blocks ejects yellow, magenta and cyan inks, and said third group of ejection outlet blocks ejects, yellow, magenta and cyan inks.

8. A recording apparatus comprising:

a recording head assembly for ejecting ink to effect recording on a recording material while moving in a main scanning direction relative to the recording material, said recording head assembly including a first group of ejection outlet blocks including a plurality of ejection outlets arranged substantially in a subscan direction, which is different from the main scanning direction, for ejecting record improving liquid for improving record property on the recording material, the record improving liquid including at least one agent for making coloring material in the ink insoluble or coagulated; a second group of ejection outlet blocks arranged substantially in the subscan direction, each of said ejection outlet blocks in the second group including a plurality of ejection outlets arranged substantially in the subscan direction, said ejection outlet blocks in the second group being effective to eject through the ejection outlets therein first inks of different colors having first densities, respectively; and a third group of ejection outlet blocks arranged substantially in the subscan direction, each of said ejection outlet blocks in the third group including a plurality of ejection outlets arranged substantially in the subscan direction, said ejection outlet blocks in the third group being effective to eject through the ejection outlets therein second inks of different colors, the second inks having the same colors as the first inks, respectively, and the second inks having second densities which are lower than the first densities, respectively, wherein said first group of ejection outlet blocks, said second group of ejection outlet blocks and said third group of ejection outlet blocks are disposed in said recording head assembly and arranged side by side in a predetermined order in the main scanning direction, and said first group of ejection outlet blocks is disposed at an upstream side position with respect to the main scanning direction and said second group of ejection outlet blocks and said third group of ejection outlet blocks are disposed at a downstream side position with respect to the main scanning direction such that the record improving liquid is first ejected on the recording material and subsequently the inks are ejected thereon when recording is performed;

input means for externally inputting image information;

comparing means for comparing a density level of the image information input by said input means with a predetermined level;

ink ejection control means for controlling ejection of ink onto the recording material based on the input information input by said input means and in accordance with an output of said comparing means, by said second group when the density level of the image information exceeds the predetermined level, and by said third group when the density level of the image information is lower than the predetermined level; and record improving liquid ejection control means, responsive to the image information input by said input means, for controlling ejection of the record improving liquid by said first group to a position where the record improving liquid is mixed on the recording material with the ink ejected by said second group or said third group.

9. An apparatus according to claim 8, further comprising means for feeding the recording material, moving means for moving said recording head assembly in the main scanning direction perpendicular to a feeding direction of said feeding means, wherein the subscan direction is codirectional with the feeding direction, and the main scanning direction is codirectional with movement of said recording head assembly.

10. An apparatus according to claim 8, wherein the image information is color image information including image information for a plurality of colors.

11. An apparatus according to claim 8, wherein said recording head assembly comprises thermal energy generating means for generating thermal energy for the ink or the record improving liquid.

12. An apparatus according to claim 8, further comprising means for receiving and means for transmitting the image information.

13. An apparatus according to claim 8, further comprising means for processing and means for outputting the image information.

14. An apparatus according to claim 8, further comprising means for reading an original and means for outputting the image information.

15. A recording apparatus according to claim 8, wherein said first group of election outlet blocks, said third group of election outlet blocks and said second group of ejection outlet blocks are arranged as listed in the main scanning direction.

16. A recording apparatus according to claim 8, wherein the first inks of different colors and the second inks of different colors include yellow, magenta and cyan inks, said second group of ejection outlet blocks ejects yellow, magenta and cyan inks, and said third group of ejection outlet blocks ejects, yellow, magenta and cyan inks.

17. A recording apparatus according to claim 8, wherein a liquid ejecting operation by the first group of ejection outlet blocks and ink ejecting operations by said second group of ejection outlet blocks and by said third group of ejection outlet blocks are carried out in one direction of main scanning.

18. A recording method comprising the steps of:

providing a recording head assembly for ejecting ink to effect recording on a recording material while moving in a main scanning direction relative to the recording material, said recording head assembly including a first group of ejection outlet blocks including a plurality of ejection outlets arranged substantially in a subscan direction, which is different from the main scanning direction, for ejecting record improving liquid for improving record property on the recording material, the record improving liquid including at least one agent for making coloring material in the ink insoluble or coagulated; a second group of ejection outlet blocks arranged substantially in the subscan direction, each of said ejection outlet blocks in the second group including a plurality of ejection outlets arranged substantially in the subscan direction, said ejection outlet blocks in the second group being effective to eject through the ejection outlets therein first inks of different colors having first densities, respectively; and a third group of ejection outlet blocks arranged substantially in the subscan direction, each of said ejection outlet blocks in the third group including a plurality of ejection outlets arranged substantially in the subscan direction, said ejection outlet blocks in the third group being effective to eject through the ejection outlets therein second inks of different colors, the second inks having the same colors as the first inks, respectively, and the second inks having second densities which are lower than the first densities, respectively, wherein said first group of ejection outlet blocks, said second group of ejection outlet blocks and said third group of ejection outlet blocks are disposed in said recording head assembly and arranged side by side in a predetermined order in the main scanning direction, and the first group of ejection outlet blocks is disposed at an upstream side position with respect to the main scanning direction and the second group of ejection outlet blocks and the third group of ejection outlet blocks are disposed at a downstream side position with respect to the main scanning direction such that the record improving liquid is first ejected on the recording material and subsequently the inks are ejected thereon when recording is performed;

externally inputting image information;

comparing a density level of the image information with a predetermined level;

ejecting from the first group of ejection outlet blocks, in accordance with the image information, the record improving liquid onto a position of the recording material;

ejecting the first ink onto the position of the recording material to mix with the record improving liquid, in accordance with a result of said comparing step, by said second group of ejection outlet blocks when the density level of the image information exceeds the predetermined level; and ejecting the second ink onto the position of the recording material to mix with the record improving liquid, in accordance with a result of said comparing step, by said third group when the density level of the image information is lower than the predetermined level, wherein said second group of ejection outlet blocks is provided for ejecting different color inks, and said third group of ejection outlet blocks is provided for ejecting the different color inks.

19. A recording method according to claim 18, wherein the first group of election outlet blocks, the third group of election outlet blocks and the second group of election outlet blocks are arranged as listed in the main scanning direction.

* * * * *

UNITED STATES PATENT AND TRADEMARK OFFICE

CERTIFICATE OF CORRECTION

PATENT NO. : 6,264,305 B1
DATED : July 24, 2001
INVENTOR(S) : Inui et al.

It is certified that error appears in the above-identified patent and that said Letters Patent is hereby corrected as shown below:

Drawings
Sheet 6 of 14, "RECEITION" should read -- RECEPTION -- and "CARRIAGE," should read -- CARRIAGE --.
Sheet 12 of 14, "TELEPOHE" should read -- TELEPHONE --.

Column 1,
Line 28, "results in" should be deleted.
Line 57, "is" should be deleted.

Column 3,
Line 3, "ir" should read -- in --.
Line 41, "making" should read -- make --.

Figure 12A:
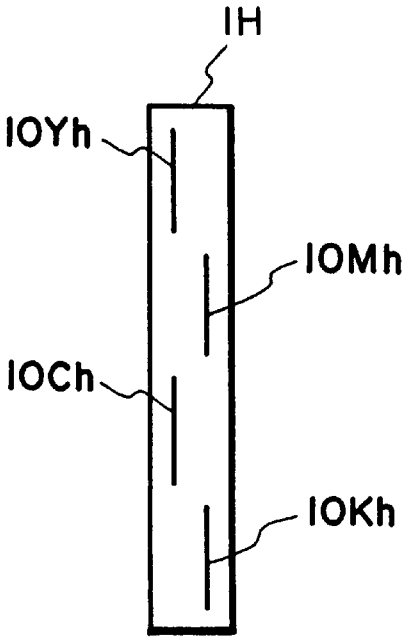
FIG. 12(*a*) and 12(*b*) show another structure of a recording head.
Figure 12B:
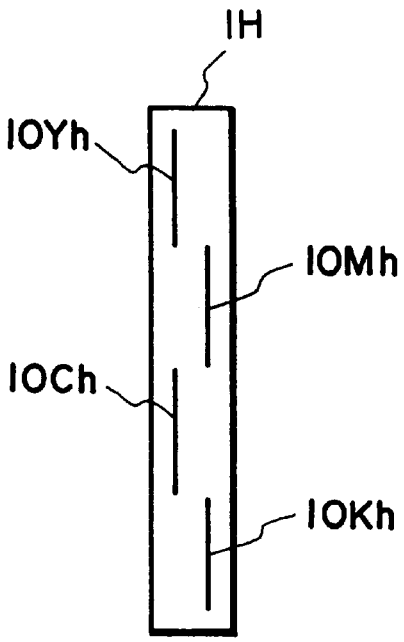

Column 4,
Line 22, "FIG. 12(a)" should read -- FIGS. 12(a) --.
Line 53, "end" should read -- and --.

Column 5,
Line 15, “Hexanetrial” should read -- Hexanetriol --.

Column 7,
Line 7, "head 1L." should read -- head 1S. --.
Line 22, "memory 307" should read -- memory 308 --.
Line 23, "Y1," should read -- Y2, --.
Line 46, "309 KY," should read -- 309 KH, --.
Line 48, "illustrates" should read -- illustrate --.
Line 54, "outlets k," should read -- outlets 10Sk, --.
Line 64, "10Cs" should read -- 10Cl --.

Column 8,
Line 42, "controller 318" should read -- controller 310 --.
Line 45, "controller 31" should read -- controller 310 --.

UNITED STATES PATENT AND TRADEMARK OFFICE

CERTIFICATE OF CORRECTION

PATENT NO. : 6,264,305 B1
DATED : July 24, 2001
INVENTOR(S) : Inui et al.

It is certified that error appears in the above-identified patent and that said Letters Patent is hereby corrected as shown below:

Column 9,
Line 23, "are" should read -- is --.
Line 45, "are" should read -- is --.

Column 10,
Line 27, "provided" should read -- provided in a --.
Line 40, "(= 38 + 3 + 32)" should be deleted.
Line 47, " 21Yh, and the" should read --and 21Yh --.
Line 48, "numbers of" should be deleted.

Column 11,
Line 6, "ccomplished" should read -- accomplished --.
Line 7, "hen" should read -- When --.

Column 12,
Line 4, "right" should read -- light --.
Line 6, "light" should read -- right --.
Line 8, "to" should read -- to be --.
Line 56, "solutoin" should read -- solution --.

Column 13,
Line 49, "some" should read -- same --; and "is" should be deleted.

Column 15,
Line 31, "applied the" should read -- applied. The --.
Line 36, "left," should read -- left unused, --.
Line 38, "producing" should read -- produces --.

Column 16,
Line 11, "speaker 502" should read -- speaker 505 --.

Column 17,
Line 5, "sender 501" should read -- sender --.
Line 32, "election" should read -- ejection --.

UNITED STATES PATENT AND TRADEMARK OFFICE

CERTIFICATE OF CORRECTION

PATENT NO. : 6,264,305 B1
DATED : July 24, 2001
INVENTOR(S) : Inui et al.

It is certified that error appears in the above-identified patent and that said Letters Patent is hereby corrected as shown below:

Column 18,
Line 9, "Arecording" should read -- A recording --.
Lines 28, 29 and 30, "election" should read -- ejection --.
Line 37, "ejects," should read -- ejects --.

Column 19,
Lines 61 and 62, "election" should read -- ejection --.

Column 20,
Line 4, "ejects," should read -- ejects --.

Column 22,
Line 6, "election" should read -- ejection --.
Line 7, "election" (both occurrences) should read -- ejection --.

Signed and Sealed this

Sixth Day of August, 2002

*Attest:*

*Attesting Officer*

JAMES E. ROGAN
*Director of the United States Patent and Trademark Office*